US008668304B1

(12) United States Patent
Irving et al.

(10) Patent No.: US 8,668,304 B1
(45) Date of Patent: Mar. 11, 2014

(54) INKJET PRINTING SYSTEM

(75) Inventors: Mark Edward Irving, Rochester, NY (US); Kurt Michael Schroeder, Spencerport, NY (US); Joseph W. Hoff, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 7 days.

(21) Appl. No.: 13/600,631

(22) Filed: Aug. 31, 2012

(51) Int. Cl.
*B41J 2/015* (2006.01)

(52) U.S. Cl.
USPC ..... 347/20

(58) Field of Classification Search
USPC ..... 347/20, 65, 84–87, 95, 96, 100; 522/42, 522/84, 85; 523/160, 161; 106/31.6, 31.13, 106/31.27, 31.78
See application file for complete search history.

(56) References Cited

U.S. PATENT DOCUMENTS

| | | | | |
|---|---|---|---|---|
| 5,233,369 | A | 8/1993 | Carlotta et al. | |
| 5,453,771 | A | 9/1995 | Waseda et al. | |
| 5,554,739 | A | 9/1996 | Belmont | |
| 5,609,671 | A | 3/1997 | Nagasawa | |
| 5,682,189 | A | 10/1997 | Takagi | |
| 5,703,633 | A | 12/1997 | Gehrer et al. | |
| 5,718,746 | A | 2/1998 | Nagasawa et al. | |
| 5,803,959 | A | 9/1998 | Johnson et al. | |
| 5,861,447 | A | 1/1999 | Nagasawa et al. | |
| 5,922,118 | A | 7/1999 | Johnson et al. | |
| 5,953,023 | A * | 9/1999 | Shimomura et al. | 347/20 |
| 6,099,632 | A | 8/2000 | Nagasawa et al. | |
| 6,186,621 | B1 | 2/2001 | Pew | |
| 6,431,672 | B1 | 8/2002 | Ardito et al. | |
| 6,852,156 | B2 | 2/2005 | Yeh et al. | |
| 6,880,921 | B2 | 4/2005 | Aponte et al. | |
| 7,232,480 | B2 | 6/2007 | Momose et al. | |
| 7,252,378 | B2 | 8/2007 | Lee | |
| 7,290,871 | B2 | 11/2007 | Greer et al. | |
| 2007/0028800 | A1 | 2/2007 | Szajewski | |
| 2008/0206465 | A1 | 8/2008 | Han-Adebekun et al. | |
| 2009/0309940 | A1 | 12/2009 | Price | |
| 2009/0309941 | A1 | 12/2009 | Price et al. | |
| 2010/0092669 | A1 | 4/2010 | Irving et al. | |
| 2011/0057981 | A1* | 3/2011 | Aruga et al. | 347/20 |
| 2011/0216123 | A1* | 9/2011 | Tamai et al. | 347/20 |

FOREIGN PATENT DOCUMENTS

| | | |
|---|---|---|
| WO | WO 2007/138624 | 12/2007 |

* cited by examiner

*Primary Examiner* — Kristal Feggins
(74) *Attorney, Agent, or Firm* — Christopher J. White

(57) ABSTRACT

An inkjet printing system including an inkjet printer having a printhead and an inkjet ink in an ink tank supplying the inkjet ink to the printhead, wherein the ink tank includes a free ink compartment and a capillary media compartment vented to the atmosphere and in fluid communication with ink in the free ink compartment, and wherein the inkjet ink includes water, a self-dispersing carbon black pigment having greater than 11 weight % volatile surface functional groups, and a surfactant at a concentration of 0.10 weight percent or less, and having a static surface tension of 37.5 dynes/cm or less at 25° C. The system provides high print density and text sharpness when printed onto an ink receiving medium, and provides good performance in a bubbler-type ink tank which reduces the amount of ink trapped in the ink tank.

20 Claims, 5 Drawing Sheets

INKJET PRINTING SYSTEM

FIELD OF THE INVENTION

The present invention relates to an inkjet system employing a bubbler ink tank and an ink containing water and carbon black self-dispersed pigment.

BACKGROUND OF THE INVENTION

Inkjet printing is a non-impact method for producing printed images by the deposition of ink droplets in a pixel-by-pixel manner to an image-recording element in response to digital data signals. There are various methods that may be utilized to control the deposition of ink droplets on the image-recording element to yield the desired printed image. In one process, known as drop-on-demand inkjet, individual ink droplets are projected as needed onto the image-recording element to form the desired printed image. Common methods of controlling the projection of ink droplets in drop-on-demand printing include piezoelectric transducers and thermal bubble formation. In another process, known as continuous inkjet, a continuous stream of droplets is charged and deflected in an image-wise manner onto the surface of the image-recording element, while un-imaged droplets are caught and returned to an ink sump. Inkjet printers have found broad applications across markets ranging from desktop document and photographic-quality imaging, to short run printing and industrial labeling.

The inks used in the various inkjet printers can be classified as either dye-based or pigment-based. A dye is a colorant that is dissolved in the carrier medium. A pigment is a colorant that is insoluble in the carrier medium, but is dispersed or suspended in the form of small particles. These small particles can be stabilized against flocculation and settling by the use of distinct dispersing agents such as surfactants, oligomers, or polymers, or they can be directly functionalized to provide a self-dispersing characteristic. In either case the carrier medium can be a liquid or a solid at room temperature. Commonly used carrier media include water, mixtures of water and organic co-solvents, and high boiling organic solvents such as hydrocarbons, esters, ketones, alcohols, and ethers.

Pigment-based inkjet inks are often preferred over dye-based inkjet inks because of the superior image stability typically observed with the pigment-based inks. Self-dispersed pigments in turn are often preferred over surfactant-dispersed, oligomer-dispersed or polymer-dispersed pigments because of their greater stability to a variety of ink formulations and environmental keeping conditions. Self-dispersed pigments are typically used when high density and sharp images are required such as for the printing of text and graphics, and are especially useful when printing on to plain papers (ie. papers not specifically designed to render photographic quality images).

Self-dispersed pigments useful for inkjet printing have been prepared by a number of different processes. U.S. Pat. Nos. 5,554,739; 5,803,959; and 5,922,118 disclose covalent functionalization of pigment surfaces using diazonium compounds. U.S. Pat. Nos. 5,609,671; 5,718,746; 6,099,632; and 7,232,480 describe anionic self-dispersed pigments prepared by a hypochlorite oxidation process. U.S. Pat. No. 6,852,156 describes anionic pigments prepared by ozone oxidation.

Among the different types of self-dispersed pigments, those having a high degree of surface functionalization provide advantages in the printing of inkjet images. US Patent Publication No. 2007/0028800 discloses self-dispersed pigments having a charge equivalence of at least 0.5 mEq/g that have been carboxylate functionalized. U.S. Pat. No. 5,861,447 and US Patent Publication No. 2008/0206465 disclose self-dispersed pigments having greater than 11 weight % volatile surface functional groups.

Although self-dispersed pigments have a number of advantages when used in inkjet inks, they also present disadvantages. For example, self-dispersed pigment inks are particularly susceptible to smearing, especially with respect to highlighter markers used in the marking of text images. It known in the art of self-dispersed pigment inks to add water-soluble polymers, neutralized with organic or inorganic bases, to improve the smear resistance of the printed images. The presence of polymers in the inks can present additional limitations in ink performance. The presence of significant amounts of polymers in a self-dispersed pigment ink, e.g., can reduce the amount of achievable density in the printed image. US Patent Pub. No. 2010/0092669 discloses inkjet inks comprising water, a self-dispersing carbon black pigment having greater than 11 weight % volatile surface functional groups, and a water soluble polymer containing carboxylate groups, wherein the ink also contains an organic base having a pKa>7.5 and an optional inorganic base in combined amounts sufficient to provide alkaline equivalents of at least 150% of the acid equivalents of the water soluble polymer, where the equivalents of the organic base are greater than or equal to the equivalents of the inorganic base. Such inks are described as providing high print density and text sharpness when printed onto an ink receiving medium, and reduced polymer deposits on components of the printing system during periods of latency.

A component of nearly all modern day inkjet printers is an ink tank that delivers ink to the printhead in order to render a printed image. The ink tank prevents leakage of the ink during manufacture, storage, transportation, and the printing operation itself. The ink tank should be capable of containing the ink even under conditions where the pressure within the tank changes due to environmental conditions. For example, pressure variations within an ink tank can occur due to changes in ambient temperature such as when a tank is stored at elevated temperatures in a warehouse or a particular geographic region where high temperatures are encountered. Pressure variations within an ink tank can also occur when the tank is subjected to changes in barometric pressure such as transporting the tank in an airplane or a geographic elevation high above sea level. To this extent, most modern day inkjet ink tanks are designed with some means of pressure regulation to prevent loss of ink during substantial changes in temperature or pressure.

Various designs for regulating the pressure within an inkjet ink tank are known including, bubble generators, reverse bubblers, diaphragms, capillary media and bags. Each of these designs has limitations in the overall system performance of the tank. Ink tanks that use capillary media, such as a foam, fiber or felt, to store ink as a means for pressure regulation have the disadvantage that ink resides directly in the small passages of the capillaries. This is particularly problematic for pigmented inks since pigment particles having sizes greater than about 20 nanometers in diameter are subject to settling phenomena. This is certainly the case for most modern day pigmented inks that have particle diameters in the range of 20 to 500 nanometers.

Pigmented ink can remain in an ink tank for several years from the time of manufacture through storage and use of the tank and this provides ample opportunity for the pigment particles to settle. Ink tank designs where ink is stored in capillary media leads to a situation where pigment particles are restricted in motion within the small passages of the capillary media. This restriction in particle movement is further complicated by the so-called Boycott Effect, wherein the observed sedimentation rate is increased in proportion to the available horizontal surface area within a capillary. For a more detailed description of the Boycott Effect see, Boycott, A. E., Nature, 104: 532, 1920. Both complications lead to an inhomogeneous distribution of pigment particles within the ink carrier fluid that can manifest itself as defective images during the printing process. For example, the non-homogeneous pigmented ink can result in images having a textured appearance reminiscent of a wood grain appearance if the pigmented ink is stored in the capillary media within an ink tank. This leads to a limitation in the selection of the pigment particle size since larger particles, which can be beneficial to providing higher optical density in printed regions, are disadvantaged from a settling and homogeneity standpoint when stored in a capillary media.

A further limitation for ink tanks using capillary media is the wasted ink associated with the capillary media. Ink tank designs where capillary media is used to store ink can result in a finite amount of ink that remains trapped in the capillary media at the end of the useful life of the tank. Ink that remains trapped is effectively wasted ink as it is not available for transport to the printhead and ultimately for printing of an image. It would be desirable to minimize the amount of ink trapped in the capillary media of an ink tank.

Designs are known for ink tanks having a free ink compartment and a capillary media compartment vented to the atmosphere and in fluid communication with ink in the free ink compartment, such as U.S. Pat. Nos. 5,682,189, 5,703,633, 6,880,921, 7,252,378, and 7,290,871. In such multi-compartment ink tanks, when sufficient pressure differential exists between compartments, air from the atmosphere is provided through the vented capillary media compartment and into the free ink compartment, causing bubbles to enter the free ink compartment, and at least partially reduce the pressure differential. Such multi-compartment ink tanks may thus be described as "bubbler" ink tanks. Designs for inkjet tanks are also known where two capillary media of different porosities are present in a chamber where ink is stored, such as U.S. Pat. Nos. 5,233,369, 5,453,771, 6,186,621, 6,431,672, and PCT International Publication Number WO 2007/138624. US Pat. Pub. Nos. 2009/0309940 and 2009/0309941 disclose multi-compartment ink tanks with further desirable features.

SUMMARY OF THE INVENTION

It is desired to provide an inkjet printing system employing an ink composition comprising self-dispersing pigments that can provide high print density and text sharpness when printed onto an ink receiving medium, and which further provides good performance in a bubbler type ink tank to enable reduction in the amount of ink trapped in the ink tank.

The invention provides an inkjet printing system comprising an inkjet printer having a printhead and an inkjet ink in an ink tank supplying the inkjet ink to the printhead, wherein the ink tank comprises a free ink compartment and a capillary media compartment vented to the atmosphere and in fluid communication with ink in the free ink compartment, and wherein the inkjet ink comprises water, a self-dispersing carbon black pigment having greater than 11 weight % volatile surface functional groups, and a surfactant at a concentration of 0.10 weight percent or less, and having a static surface tension of 37.5 dynes/cm or less at 25° C.

Alternate embodiments include the ink itself and a printing process employing the printing system. The system provides high print density and text sharpness when printed onto an ink receiving medium, and provides good performance in a bubbler-type ink tank which reduces the amount of ink trapped in the ink tank.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
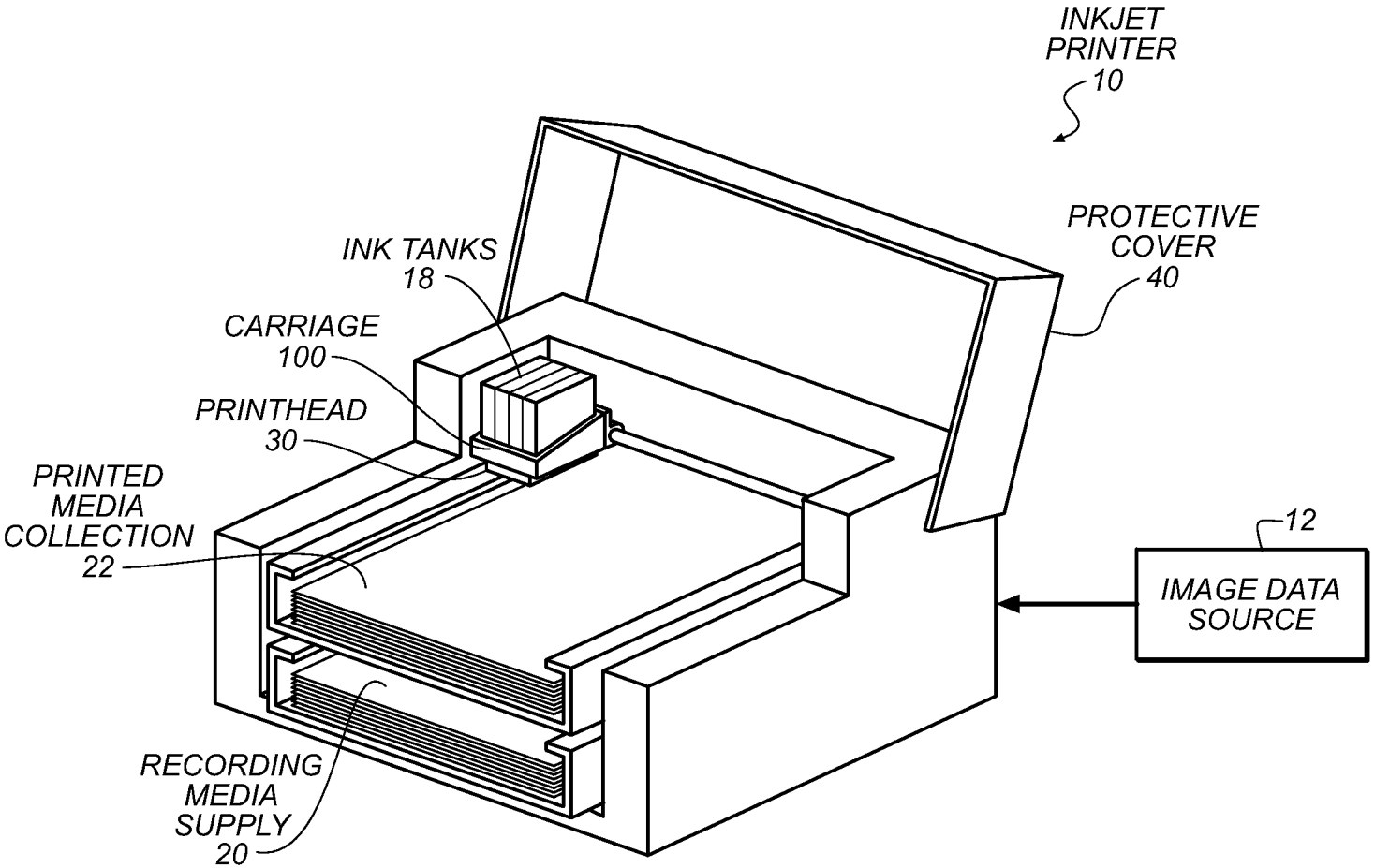
FIG. 1 is a schematic view of an inkjet printing system of the invention.

As used herein, self-dispersing pigment is defined as a pigment that retains a state stably dispersed in a liquid carrier medium, such as water, a water-soluble organic solvent, or a liquid mixture thereof, without requiring use of any dispersing agent.

The self-dispersed pigment useful in the present invention is, for example, a pigment in which at least one anionic group, has been bonded directly to the surface of the pigment. In one embodiment the pigment is a carbon black pigment that has been surface modified to produce carboxylate groups on the surface of the pigment. The surface-modified pigment can be one produced by a method involving wet oxidation with a hypohalous acid or a salt thereof, by treatment in a plasma, or by oxidation in the presence of ozone. Hypohalous acids or salts thereof include sodium hypochlorite, potassium hypochlorite, sodium hypobromite, and potassium hypobromite. Among them, sodium hypochlorite is particularly preferred from the viewpoints of reactivity and cost. Specifically, the method involving wet oxidation with a hypohalous acid or a salt thereof may be carried out as follows.

A pigment and a surface modifier (for example, sodium hypochlorite) are heated and dispersed or stirred in a suitable amount of water. For example, a ball mill, an attritor, a colloid mill, or a sand mill with glass, zirconia, alumina, stainless steel, magnetic, or other beads added thereto may be used for stirring. In this case, preferably, the pigment may be previously ground to a desired particle size. Alternatively, the pigment may be reacted with the surface modifier while grinding the pigment. The grinding may be carried out by means of a rotary homogenizer or an ultrasonic homogenizer. Beads and coarse particles are separated from the dispersion after stirring and oxidation, followed by the removal of by-products of the oxidizing agent in order to perform purification. Thus, an aqueous pigment dispersion is obtained. If necessary, for example, concentration by a separation membrane or the like, filtration through a metallic filter or a membrane filter, classification by centrifugation, or neutralization with a hydroxide of an alkali metal salt or an amine may be carried out. A modified carbon black produced by the hypohalous oxidation method generally as described in U.S. Pat. No. 6,488,753 has a high surface carboxylic acid content. As a result, the dispersibility of the modified carbon black in water is very high. Commercially available products may be used as the above pigment, and desirable examples thereof include BONJET® CW-1, BONJET® CW-2 and BONJET® CW-3 manufactured by Orient Corporation of America, and AQUA-BLACK® 162 and AQUA-BLACK® 164 from Tokai Carbon Co., Ltd.

The following water-insoluble pigments are among those useful as substrates suitable for chemical modification, as described previously, into the pigments in the practice of the invention; however, this listing is not intended to limit the invention. The following pigments are available from Cabot Corp.: MONARCH® 1400, MONARCH® 1300, MONARCH® 1100, MONARCH® 1000, MONARCH® 900, MONARCH® 880, MONARCH® 800, and MONARCH® 700. The following pigments are available from Ciba: IGRALITE® RUBINE 4BL. The following pigments are available from Columbian: RAVEN® 7000, RAVEN® 5750, RAVEN® 5250, RAVEN® 5000, and RAVEN® 3500. The following pigments are available from Evonik: Color Black FW 200, Color Black FW 2, Color Black FW 2V, Color Black FW 1, Color Black FW 18, Color Black S 160, Color Black S 170, Special Black 6, Special Black 5, Special Black 4A, Special Black 4, Printex U, Printex V, Printex 140U, and Printex 140V. The following pigment is available from DuPont: TI-PURE® R-101. The following pigment is available from Hoechst: Permanent Rubine F6B. The following pigment is available from Sun Chemical: LHD9303 Black.

The surface chemistry of the carbon black pigment surface after treatment affects its performance on plain paper, since all carbon blacks have chemisorbed oxygen complexes (i.e., carboxylic, quinonic, lactonic, or phenolic groups) on their surfaces to varying degrees depending on the surface treatment conditions and mechanism. One way to characterize the amount of total surface groups, as well as the types of the surface groups (i.e., lactonic vs. carboxylic), is through the measurement of volatile surface functional groups. Thermogrametric analysis (TGA) is used to obtain such information by monitoring the weight change that occurs as the carbon black dispersion sample is being heated.

Specifically, volatile surface functional group and wt % volatile lactonic functional group are obtained following the 5 steps as described below:

Step 1) 95 mls of Reagent grade acetonitrile is added to the 5 mls of carbon black dispersion. This destabilizes the pigment suspension fairly rapidly.

Step 2) Collect the pigment cake by centrifugation at 7500 RPM for 1 hour and place it in a vacuum oven at 80 degrees C. for 16 hours.

Step 3) Place the pigment cake on the sample pan of a standard TGA oven to collect the weight loss using the following scan conditions: $1^{st}$ temperature range: 25° C. to 700° C., with nitrogen as the purge gas at a rate of 60 vv/min to the TGA oven and 40 cc/min to the TGA balance. The heating rate is 10° C./min. From the temperature range of 700° C. to 1000° C., switch to air at the same flow rate, with a heating rate of 10° C./min. The % of weight loss is recorded during the entire temperature scan range of 25° C. to 1000° C.

Step 4) Calculate the total weight % of volatile surface functional group on the carbon black dispersion surface by the following equation:

wt % volatile surface functional group=(weight loss 125° C.→700° C.)/(weight loss 125° C.→700° C.+weight loss 700° C.→805° C.).

This is based on the physical understanding during the decomposition of carbon black pigment cake: weight losses before 125° C. are due to the volatile component in the sample; weight losses between 125° C. and 700° C. are associated with surface functional group on the carbon black dispersion particles; weight losses between 700° C. and 805° C. with the air as purge gas is due to the decomposition of carbon black through combustion.

Step 5) Calculate the weight % of lactone functional group on the carbon black dispersion surface using the following equation:

wt % volatile lactonic functional group=(weight loss 125° C.→400° C.)/(weight loss 125° C.→700° C.+weight loss 700° C.→805° C.).

This is based on the results from pyrolytic gas chromatograph indicating that lactone groups decomposes around 358° C. and carboxyl groups decomposes around 650° C.

The self-dispersing pigments employed in the present invention have a volatile surface functional group content greater than 11 weight %, more desirably greater than 14%, and in one particularly useful embodiment greater than 18%. Furthermore, it is desirable that the pigment has a volatile lactonic functional group content greater than 5%. Pigments possessing these features have been found to provide improved print density on plain papers, good text quality, improved print durability such as waterfastness and excellent jetting performance over an extended printing period. They further provide good print uniformity over a wide variety of inkjet receivers.

The self-dispersing pigments of the present invention desirably contain anionic groups which are neutralized with an inorganic metal cation selected from sodium, potassium, lithium, and rubidium when supplied as a pigment dispersion prior to ink manufacturing.

The self-dispersing pigments of the present invention typically have a median particle diameter between 55 nm and 200 nm, desirably between 55 nm and 170 nm, and in one particularly useful embodiment between 55 and 140 nm. As used herein, median particle diameter refers to the 50th percentile of the particle size distribution such that 50% of the volume of the particles is composed of particles having diameters smaller than the indicated diameter. It is understood the pigment dispersion of the invention can be aggregates of primary carbon black particles smaller than the mean particle diameter from above. Typical primary particle sizes of the carbon black particles comprising the pigment dispersion may be in the range of 10 nm to 30 nm. The median particle diameter in the present invention is measured by using a Microtrac II Ultrafine Particle Analyzer (UPA) from Microtrac, Inc.

Ink compositions employed in the present invention in certain embodiments may preferably contain a water-soluble polymer having carboxylic acid groups. As used herein, the term "water-soluble" is defined as a sufficient number of ionizable groups on the polymer are neutralized with base such that the resultant polymer solution in water is visually clear. The carboxylic acid groups on the water-soluble polymers useful in embodiments of the present invention are converted to carboxylate groups when neutralized with an appropriate base.

Desirable water-soluble polymers useful in embodiments of the present invention are copolymers prepared from at least one ethylenically unsaturated monomer comprising a carboxylic acid group copolymerized with additional monomers described herein. The ethylenically unsaturated monomer comprising a carboxylic acid can be a mono carboxylic acid or a dicarboxylic acid. Examples of monomers useful as the first monomer include, but are not limited to, acrylic acid, methacrylic acid, fumaric acid, crotonic acid, itaconic acid, ethacrylic acid, mesaconic acid, cinnamic acid, carboxyethyl acrylate, carboxymethylacrylate, α-chloro-acrylic acid, and combinations thereof. Desirably, the first monomer is acrylic acid or methacrylic acid.

The monomer comprising a carboxylic acid group is typically polymerized at from 20 to 75 weight percent based on the total weight of the monomers used in the chain copolymerization of the water-soluble polymer, and more desirably from 20 to 50 weight percent. A particularly useful amount of first monomer comprising a carboxylic acid group used to prepare the polymer is from 20 to 35 weight percent of the total monomers.

The water-soluble polymer useful in embodiments of the present invention is desirably obtained by copolymerizing at least one hydrophobic monomer with the carboxylic acid group containing monomers defined herein. Suitable hydrophobic monomers are, in principle, all hydrophobic monomers having a water-solubility of less than 60 g/l at 25° C., and which are copolymerizable with the carboxylic acid group containing monomers of the present invention. They include, in particular, the $C_1$-$C_{21}$-alkyl esters of monoethylenically unsaturated $C_3$-$C_6$ carboxylic acids, especially the esters of acrylic and methacrylic acid with $C_1$-$C_{21}$-alkanols or $C_5$-$C_{10}$ 4-cycloalkanols such as methanol, ethanol, n-propanol, isopropanol, n-butanol, isobutanol, 2-butanol, tert-butanol, n-pentanol, n-hexanol, 2-ethylhexan-1-ol, n-octanol, n-decanol, n-dodecanol, n-tridecanol, n-tetradecanol, n-hexadecanol, n-stearyl alcohol, n-behenyl alcohol, 2-propylheptan-1-ol, cyclohexanol, 4-tert-butylhexanol, 2,3,5-trimethylcyclohexanol, benzyl alcohol, phenyl alcohol, and phenylethyl alcohol. Further suitable non-ionizable hydrophobic monomers are the di-$C_1$-$C_{21}$-alkyl esters of ethylenically unsaturated dicarboxylic acids, such as maleic, fumaric, or itaconic acid, with the abovementioned $C_1$-$C_{21}$-alkanols or $C_5$-$C_{10}$-cycloalkanols, examples being dimethyl maleate or di-n-butyl maleate. Vinlyaromatic compounds such as styrene, a-methyl styrene, t-butyl styrene, ethylstyrene, isopropylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy)styrene, methoxystyrene, 4-methoxy-3-methylstyrene, dimethoxystyrene, chlorostyrene, dichlorostyrene, trichlorostyrene, bromostyrene, and vinyl toluene are also suitable as non-ionizable hydrophobic monomers, and their aromatic ring may be unsubstituted or substituted by one or more substituents selected from $C_1$-$C_{10}$-alkyl, halo, especially chloro, and/or hydroxyl, which in its turn may also be ethoxylated. The non-ionizable hydrophobic monomers additionally embrace the vinyl, allyl, and methallyl esters of linear or branched aliphatic carboxylic acids of 2 to 20 carbons, such as vinyl acetate, propionate, butyrate, valerate, hexanoate, 2-ethylhexanoate, decanoate, laurate, and stearate, and the corresponding allyl and methallyl esters. Additional suitable hydrophobic monomers include the vinyl, allyl and methallyl ethers of linear, or branched aliphatic alcohols of 2 to 20 carbons, such as vinyl methyl, ethyl, dodecyl, hexadecyl, and stearyl ethers. Suitable hydrophobic monomers also include olefins and halogenated olefins such as, dicyclopentadiene, ethylene, propylene, 1-butene, 5,5-dimethyl-1-octene, vinyl chloride, or vinylidene chloride.

The hydrophobic monomer is typically polymerized at from 20 to 90 weight percent based on the total weight percent of the monomer in the chain polymerization, and desirably from 30 to 85 weight percent. A particularly useful amount of hydrophobic third monomer used to prepare the polymer is from 40 to 80 weight percent of the total monomers in the chain polymerization. In one exemplary embodiment, the hydrophobic monomer is an alkylaryl acrylic monomer, such as benzyl methacrylate or benzyl acrylate. The hydrophobic monomer can be a mixture of two or more hydrophobic monomers and can be a mixture of an acrylic and a styrenic monomer, for example, styrene and benzyl methacrylate.

Furthermore, the water-soluble polymer useful in embodiments of the present invention preferably has a sufficient amount of acid groups in the molecule to have an acid number of between 100 and 270, desirably between 100 and 250, and in one particularly useful embodiment between 100 and 215. The acid number is defined as the milligrams of potassium hydroxide required to neutralize one gram of dry polymer. The acid number of the polymer may be calculated by the formula given in the following equation: Acid number= (moles of acid monomer)*(56 grams/mole)*(1000)/(total grams of monomers) where, moles of acid monomer is the total moles of all acid group containing monomers that comprise the polymer, 56 is the formula weight for potassium hydroxide and total grams of monomers is the summation of the weight of all the monomers, in grams, comprising the target polymer.

Desirable water-soluble copolymers may be styrene-acrylic copolymers comprising a mixture of vinyl or unsaturated monomers, including at least one styrenic monomer and at least one acrylic monomer, at least one of which monomers has an acid or acid-providing group. Such polymers are disclosed in, for example, U.S. Pat. Nos. 4,529,787; 4,358,573; 4,522,992; and 4,546,160. Desirable polymers include, for example, styrene-acrylic acid, styrene-acrylic acid-alkyl acrylate, styrene-maleic acid, styrene-maleic acid-alkyl acrylate, styrene-methacrylic acid, styrene-methacrylic acid-alkyl acrylate, and styrene-maleic acid half ester, wherein each type of monomer may correspond to one or more particular monomers. Examples of preferred polymers include but are not limited to styrene-acrylic acid copolymer, (3-methyl styrene)-acrylic acid copolymer, styrene-methacrylic acid copolymer, styrene-butyl acrylate-acrylic acid terpolymer, styrene-butyl methacrylate-acrylic acid terpolymer, styrene-methyl methacrylate-acrylic acid terpolymer, styrene-butyl acrylate-ethyl acrylate-acrylic acid tetrapolymer and styrene-(α-methylstyrene)-butyl acrylate-acrylic acid tetrapolymer. Commercially available polymers useful in the present invention include copolymers of styrene and/or alphamethyl styrene and acrylic acid and/or methacrylic acid (such as the JONCRYL® BASF or TRUDOT™ MeadWestvaco polymers) or styrene maleic anhydride and styrene maleic anhydride amic acid copolymers (such as SMA® 1440, SMA® 17352, SMA® 1000, SMA® 2000, Sartomer company, Inc.). Polymers useful in embodiments of the present invention are further exemplified by those disclosed in U.S. Pat. No. 6,866,379.

The polymers useful in embodiments of the present invention are not limited in the arrangement of the monomers comprising the copolymer. The arrangement of monomers may be totally random, or they may be arranged in blocks such as AB or ABA wherein, A is the hydrophobic monomer and B is the hydrophilic monomer. In addition, the polymer make take the form of a random terpolymer or an ABC triblock wherein, at least one of the A, B, and C blocks is chosen to be the hydrophilic monomer and the remaining blocks are hydrophobic blocks dissimilar from one another. Preferably the copolymer is a random copolymer due to the ease of synthesis of such polymers.

The water-soluble polymers useful in embodiments of the invention can be prepared by emulsion polymerization, solution polymerization, or bulk polymerization techniques well known in the art. Furthermore, the polymer may have a weight average molecular weight of from 2,000 to 100,000, desirably from 4,000 to 40,000 and in one particular embodiment from 5,000 to 30,000.

When present, the water-soluble polymer useful in embodiments of the invention is preferably present in the inkjet ink generally from 0.1% to 2%, desirably from 0.1% to 1%, and in one particularly useful embodiment from 0.1% to 0.5% by weight based on the total weight of the ink. If the polymer concentration is above 2% by weight in the ink, the density of the printed image can be reduced. If the polymer concentration is below 0.1% the ejection firing performance of the ink can be compromised.

The amount of acid equivalents in the water-soluble polymer useful in embodiments of the present invention can be represented as the equivalents of total acid per gram of polymer. An equivalent of acid is equal to the number of moles of the acid that supplies one mole of hydrogen ions. The number of equivalents of an acid compound is determined according to: moles of the acid compound*number of carboxylic acid groups. For mono carboxylic acids the number of carboxylic acids is equal to 1 and for dicarboxylic acids the number of acid groups is equal to 2.

The total equivalents of acid per gram of polymer can be estimated according to:

$$= \sum_{i=1}^{n} \frac{(\text{moles of acid monomer}_i) * (\text{\# of carboxylic acid groups in monomer}_i)}{(\text{total weight of all monomers in one gram of polymer})}$$

Alternatively, the equivalents of acid per gram of polymer can be obtained by potentiometric titration of a known amount of polymer using a suitable base, such as, for example a dilute solution of sodium hydroxide. The amount of base used to fully titrate all of the carboxylate groups on the water-soluble polymer can then be used to calculate the equivalents of acid per gram of polymer.

In preferred embodiments of the present invention, the ink employed may further contain at least an organic base having a pKa>7.5, as taught in US Pat. Pub. No. 2010/0092669, the disclosure of which is incorporated by reference herein. The term "pKa" used herein is defined as the negative logarithm of the acid dissociation constant (Ka) of the conjugate acid of the organic base. The acid dissociation constant, Ka, is defined as $[H^+][B]/[BH^+]$, wherein $[BH^+]$ denotes the concentration of undissociated conjugate acid, $BH^+$, in a solution and, $[H^+]$ and [B] denote the concentrations of dissociated hydrogen ion, $H^+$, and organic base, B, thereof in the solution. Consequently, the value of pKa can be obtained from the equation: $pKa=-\log [H^+]-\log([B]/[BH^+])=pH-\log([B]/[BH^+])$. Literature values for the pKa of organic bases useful in the present invention can be found in, for example, "Dissociation of Organic Bases in Aqueous Solution," by D. D. Perrin, Butterworths, London, 1965. Alternatively, the pKa of the organic base can be determined by potentiometric titration according to the procedures outlined in, for example, "Protonation Constants of Mono-, Di-, and Triethanonolamine., Influence of the Ionic Composition of the Medium," by Juan Antelo, et. al., Journal of Chemical Engineering Data, vol. 29, 1992. The value of the pKa of the organic bases used herein is the pKa of the protonated base at 25° C. in aqueous solution, free of any added electrolytes.

As described in US Pat. Pub. No. 2010/0092669, any suitable organic base having a pKa>7.5 can be used in the ink compositions to improve the firing performance of the self-dispersing pigment ink. Typically, the pKa of the organic base is less than 10.5, desirably less than 10.0, and in one useful embodiment less than 9.5. The pKa of the base is desirably selected such that it is within the operating pH of the ink composition. Useful operating pH values for the ink compositions are from 6.0 to 10.0, desirably from 7.0 to 9.0 and in one useful embodiment, from 7.0 to 8.5. Organic bases useful in embodiments of the present invention and having a pKa>7.5 include, but are not limited to; primary amines, for example, 2-amino-2-hydroxymethyl-1,3-propanediol, 2-amino-1,3 dihydroxy-2-ethyl propane, tris(hydroxymethyl)aminomethane, and 2-amino isopropanol, secondary amines, for example, diethanol amine and diisopropanol amine, and tertiary amines, for example, triethanolamine, triisopropanolamine, methyl diethanolamine, N,N-dimethyl ethanolamine, diethyl ethanolamine, dibutyl ethanolamine, dihydroxyisopropyl ethanolamine, dihydroxyisopropyl ethylamine, dihydroxyisopropyl isopropylamine, dihydroxyisopropyl t-butylamine, dihydroxyisopropyl butylamine, dimethyl isopropanolamine, diethyl isopropanolamine, diisopropyl isopropanolamine, and dibutyl isopropanolamine.

The organic base useful in embodiments of the present invention having a pKa>7.5 can also be an amino acid selected from bicine, tricine, and N,N-bis(2-hydroxyethyl) glycine, a sulfonic acid buffer such as, 4-(2-hydroxyethyl)-1-piperazine propane sulfonic acid, 2-(N-cylcohexylamino) ethane propane sulfonic acid, N-cyclohexyl-3-aminopropane sulfonic acid, or N-tris(hydroxymethyl)-2-aminopropane sulfonic acid. Alternatively, the organic base can be a metal salt of a carbonate or bicarbonate such as, for example, sodium or potassium carbonate or bicarbonate. The alkaline equivalents of organic base are defined as the number of moles of organic base present in the ink composition.

Ink compositions employed in the present invention may further optionally contain an inorganic base. Typical inorganic bases useful in the present invention include, for example, sodium hydroxide, potassium hydroxide, lithium hydroxide, and rubidium hydroxide. The inorganic base may be used in certain embodiments of the invention to deprotonate the carboxylic acid groups on the polymer thereby rendering the polymer water-soluble. Alternatively, the inorganic base can be added to the ink composition as a separate addenda during the ink manufacturing step. The alkaline equivalents of inorganic base are defined as the number of moles of inorganic base present in the ink composition.

When inorganic base is present in the ink composition, the amount of organic base having a pKa>7.5 is preferably in excess of the inorganic base. Typically, the ratio of organic base to inorganic base is preferably greater than 1:1, desirably greater than 1.5:1 and in one particularly useful embodiment greater than 2:1. If desired, additional acidic components can be present in the ink composition and a suitable amount of excess alkaline equivalents of base can be present to neutralize these acidic species.

In preferred embodiments of the present invention wherein the ink employed includes a water-soluble polymer, an organic base having a pKa>7.5 and optional inorganic base are preferably present in the ink composition in combined amounts such that the total alkaline equivalents of base are greater than 150% of the acid equivalents of the water-soluble polymer, desirably greater than 175% and in one particularly useful embodiment greater than 200%. The amount of base preferred for inks of the present invention therefore depends on both the amount of water-soluble polymer present in the ink composition, as well as the amount of acid groups on the polymer. If the amount of total alkaline equivalents of base is less than 150% of the acid equivalents of the water-soluble polymer the ink composition can lead to fouling of the inkjet printhead nozzles. If there is insufficient amount of organic base to inorganic base, the printhead nozzles can also be fouled due to degraded jetting or from accumulation of nodules. It should be noted that these problems can be worsened when the ink composition has been held for a period of time at elevated temperatures or an extended period of time at ambient conditions.

The inkjet ink employed in the present invention further comprises a surfactant at a concentration of 0.10 weight percent or less, preferably 0.05 weight percent or less, and the ink has a static surface tension of 37.5 dynes/cm or less at 25° C., preferably 37 dynes/cm or less. If the surfactant concentration is higher than 0.10 weight percent of the ink, it has been found that the printed density of images printed with the ink are less than desired. If the static surface tension of the ink is greater than 37.5 dynes/cm, on the other hand, it has been found that the performance of the ink in a bubbler type ink tank is poor. While static surface tension of 37.5 dynes/cm or less is desired for good bubbler tank performance, the inkjet ink should have a surface tension of at least about 20 dynes/cm, as other inkjet printing parameters, such as jet velocity, separation length of the droplets, drop size, and stream stability are further affected by the surface tension and the viscosity of the ink.

The surfactants employed may be anionic, cationic, amphoteric, or nonionic, with the proviso they be selected from those effective at adjusting the surface tension of the ink to the specified level of 37.5 dynes/cm or less at 25 C when used at a concentration of 0.10 weight percent or less of the ink composition, preferably when used at a concentration of from 0.01 to 0.10 weight percent and more preferably 0.01 to 0.05 weight percent of the ink composition. Examples of suitable nonionic surfactants may include those selected from, linear or secondary alcohol ethoxylates (such as the TERGITOL™ 15-S and TERGITOL™ TMN series available from Union Carbide and the BRIJ® series from Uniquema), ethoxylated alkyl phenols (such as the TRITON™ series from Union Carbide), fluoro surfactants (such as the ZONYLS® from DuPont; and the FLUORADS™ from 3M), fatty acid ethoxylates, fatty amide ethoxylates, ethoxylated and propoxylated block copolymers (such as the PLURONIC® and TETRONIC® series from BASF, ethoxylated and propoxylated silicone based surfactants (such as the SILWET™ series from CK Witco), alkyl polyglycosides (such as the GLUCOPONS® from Cognis) and acetylenic polyethylene oxide surfactants (such as the SURFYNOLS® from Air Products and Chemicals, Inc.).

Examples of suitable anionic surfactants may include those selected from; carboxylated (such as ether carboxylates and sulfosuccinates), sulfated (such as sodium dodecyl sulfate), sulfonated (such as dodecyl benzene sulfonate, alpha olefin sulfonates, alkyl diphenyl oxide disulfonates, fatty acid taurates, and alkyl naphthalene sulfonates), phosphated (such as phosphated esters of alkyl and aryl alcohols, including the STRODEX™ series from Dexter Chemical L.L.C.), phosphonated and amine oxide surfactants and anionic fluorinated surfactants. Examples of suitable amphoteric surfactants may include those selected from betaines, sultaines, and aminopropionates. Examples of suitable cationic surfactants may include those selected from quaternary ammonium compounds, cationic amine oxides, ethoxylated fatty amines, and imidazoline surfactants. Additional examples of the above surfactants are described in "McCutcheon's Emulsifiers and Detergents," 1995, North American Editor."

In preferred embodiments of the invention, the surfactant employed in the inkjet ink is a linear or secondary alcohol ethoxylate, a phosphated ester of an alkyl or aryl alcohol, or a fluoro surfactant. Such specific types of surfactants have been found to advantageously enable effective surface tension reduction of the ink at relatively low concentrations. In a particularly preferred embodiment of the invention, the surfactant employed in the inkjet ink is a fluoro surfactant. In particular, it has been found that fluorinated surface active agents may be employed at relatively low concentrations to obtain the required static surface tension properties of inks employed in accordance with the present invention.

Fluorocarbon surfactants, or fluorosurfactants, for use in inks employed in the present invention may be independently selected as an nonionic, anionic, cationic or amphoteric or zwitterionic surfactant including at least one fluoro substituent on a carbon atom. In an embodiment, the fluorocarbon surfactant contains a perhalogenated or perfluorinated alkyl terminal group. The specific fluorocarbon surfactant compound or compounds selected may vary based on the other components in the ink. By way of example, the fluorocarbon surfactant may be selected such that its ionic character is compatible with that of other components in the inks to avoid or minimize precipitation or flocculation in the ink.

In an embodiment, the fluorocarbon surfactant may be of the formula $(R_fQ)_nA$ wherein: $R_f$ is a perfluoroalkyl group having 6 to 22 carbon atoms; Q is a divalent bridging group capable of connecting the $R_f$ with the A group; A is a water soluble group; and n is 1 or 2. The bridging Q group may be a di-radical of alkyl, aralkyl, alkylaryl, or aryl containing less than 10 carbon atoms, and may contain heteroatoms such as S, O, and N. The linkage between the bridging Q group and the water-soluble A group may be ether, ester, amide, or sulfoamido; provided it is stable under the conditions of use. The water-soluble A group may be selected from $—(OCH_2CH_2)_xOH$ wherein x is 1 to 12; —COOM and $—SO_3M$ wherein M is hydrogen, ammonium, amine, or an alkali metal such as lithium, sodium, or potassium; $—PO_4Z_y$ wherein y is 1 to 2 and Z is hydrogen, ammonium, amine, or an alkali metal such as lithium, sodium, or potassium; $—NR_3X$ wherein $R_3$ is an alkyl group of 1 to 4 carbon atoms and X is an anionic counterion selected from the group consisting of halides, acetates, and sulfonates, and other water-soluble zwitterionic groups. The balance between the size of the perfluoroalkyl group and the water-soluble group should be such that the compound as a whole has a solubility in the desired aqueous vehicle of at least 0.001% at 25° C., preferably at least 0.05% at 25° C. Suitable fluorinated compounds are commercially available from companies such as E. I. du Pont de Nemours and Company (Wilmington, Del.) as ZONYL and CAPSTONE surfactants, and from 3M Company (Minneapolis, Minn.) as FLUORAD surfactants, which may be used alone or in combinations.

In the ZONYL series of fluorocarbon surfactants, ZONYL FSO, ZONYL FSN, ZONYL FSH, and ZONYL FS-300 are exemplary nonionic fluorocarbon surfactants that may be used in the present invention. ZONYL FSO is an ethoxylated nonionic fluorocarbon surfactant having the formula $R_fCH_2CH_2O(CH_2CH_2O)_xH$, wherein $R_f$ is $F(CF_2CF_2)_y$, x is 0 to approximately 15, and y is 1 to approximately 7. As supplied, ZONYL FSO has about 50% fluorosurfactant. ZONYL FSN is a water soluble, ethoxylated non-ionic fluorosurfactant that has the structure of $R_fCH_2CH_2O(CH_2CH_2O)_xH$, wherein $R_f$ is $F(CF_2CF_2)_y$, x is 0 to approximately 25, and y is 1 to approximately 9. ZONYL FSN is supplied having about 40% fluorosurfactant. ZONYL FS-300 is a nonionic fluorosurfactant having the structure $R_fCH_2CH_2O(CH_2CH_2O)_xH$, wherein $R_f$ is $F(CF_2CF_2)_y$, x is 3 to approximately 30, and y is 2 to approximately 20, wherein X<y<Z. As supplied, ZONYL FS-300 has about 40% fluorosurfactant. ZONYL FSD is an exemplary cationic fluorosurfactant and has the structure $F(CF_2CF_2)_{1-7}$-alkyl-$N^+R_3Cl^-$. ZONYL FSD is supplied having about 30% fluorosurfactant. ZONYL FS-500 in an exemplary amphoteric fluorosurfactant and has the structure $C_6F_{13}CH_2CH_2SO_2NHC_3H_6N^+(CH_3)_2CH_2COO^-$.

ZONYL FSA, ZONYL FSP, and ZONYL FSE are exemplary anionic fluorocarbon surfactants that may be used in the present invention. ZONYL FSA is a water soluble lithium carboxylate anionic fluorosurfactant. ZONYL FSE and ZONYL FSP are water-soluble, anionic phosphate fluorosurfactants.

The FLUORAD fluorocarbon surfactants include ammonium perfluoroalkyl sulfonates (FC-120), potassium fluorinated alkyl carboxylates (FC-129), fluorinated alkyl polyoxyethylene ethanols (FC-170C), fluorinated alkyl alkoxylate (FC-171), and fluorinated alkyl ethers (FC-430, FC-431, FC-740).

Other suitable fluorosurfactants include NOVEC 4430 (a fluorosurfactant commercially available from 3M located in St. Paul, Minn.), NOVEC 4432 (a non-ionic fluorosurfactant commercially available from 3M), and NOVEC 4434 (a water-soluble non-ionic fluorosurfactant commercially available from 3M).

Other suitable fluorocarbon surfactants for use in the practice of the invention include those formed at least in part from a polymer made based on oxetane chemistry having the formula below and including a pendant perfluoroalkyl group $R_f$

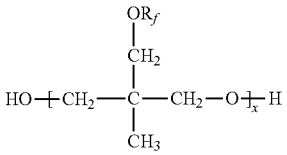

wherein the length of the pendant perfluoroalkyl group is selected from the group consisting of $C_4F_9$ or shorter including $CF_3$, $C_2F_5$, $C_3F_7$ and $C_4F_9$. In an embodiment, the oxetane-based fluorocarbon surfactant is formed from at least a polymeric material having at least one polar group and having at least one pendant group comprising an $R_f$ group, the polymeric material having at least 2 repeat units, wherein each at least one polar group, independently, is selected from a group consisting of an anion-countercation; a cation-counteranion; an amphoteric group, and a non-ionic group; wherein each $R_f$ group, independently, is selected from a group consisting of a fluorinated linear alkyl having from 1 to about 7 carbon atoms; and a fluorinated branched alkyl wherein the longest chain is from 1 to about 7 carbon atoms and each branch, independently, contains from 1 to about 3 carbon atoms; and wherein each $R_f$, whether linear or branched, has at least one carbon atom bonded to at least one fluorine atom; and wherein each $R_f$ group, independently, has at least 10% of the non-carbon atoms being fluorine atoms and the remaining non-carbon atoms being independently selected from the group consisting of: H, I, Cl, and Br. Examples of suitable oxetane-based fluorocarbon surfactants, include, but are not limited to those generally available from companies such as Omnova Solutions, Inc. of Fairlawn, Ohio under the trade name of POLYFOX fluorocarbon surfactants. Exemplary POLYFOX surfactants include POLYFOX PF-136A, POLYFOX PF-151N, POLYFOX PF-154N, and POLYFOX PF-156A.

The ink employed further preferably has physical properties compatible with a wide range of ejecting conditions, i.e., driving voltages and pulse widths for thermal inkjet printing devices, driving frequencies of the piezo element for either a drop-on-demand device or a continuous device, and the shape and size of the nozzle. The exact choice of further ink components will depend upon the specific application and performance requirements of the printhead from which they are jetted. Thermal and piezoelectric drop-on-demand printheads and continuous printheads each require ink compositions with a different set of physical properties in order to achieve reliable and accurate jetting of the ink, as is well known in the art of inkjet printing. Desired viscosities are typically no greater than 20 centipoise, and preferably in the range of about 1.0 to 10 centipoise and most preferably in the range of about 1.0 to 6 centipoise. The inkjet inks useful in the invention typically exhibit a solution density of between 1 and 1.2 g/cc.

A biocide (0.01-1.0% by weight) may also be added to prevent unwanted microbial growth which may occur in the ink over time. A preferred biocide for the inks employed in the present invention is PROXEL™ GXL (Arch UK Biocides, Ltd.) at a concentration of 0.05-0.1% by weight or/and KORDEK™ (Rohm and Haas Co.) at a concentration of 0.05-0.1% by weight (based on 100% active ingredient. Additional additives which may optionally be present in an inkjet ink composition include thickeners, conductivity enhancing agents, anti-kogation agents, drying agents, waterfast agents, dye solubilizers, chelating agents, binders, light stabilizers, viscosifiers, buffering agents, anti-mold agents, anti-curl agents, stabilizers and defoamers.

Ink compositions useful in the invention may include humectants and/or co-solvents in order to prevent the ink composition from drying out or crusting in the nozzles of the printhead, aid solubility of the components in the ink composition, or facilitate penetration of the ink composition into the image-recording element after printing. Representative examples of humectants and co-solvents used in aqueous-based ink compositions include: (1) alcohols such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; (2) polyhydric alcohols such as ethylene glycol, diethylene glycol, triethylene glycol, tetraethylene glycol, propylene glycol, polyethylene glycol, polypropylene glycol, 1,2-propane diol, 1,3-propane diol, 1,2-butane diol, 1,3-butane diol, 1,4-butane diol, 1,2-pentane diol, 1,5-pentanediol, 1,2-hexanediol, 1,6-hexane diol, 2-methyl-2,4-pentanediol, 1,2-heptane diol, 1,7-hexane diol, 2-ethyl-1,3-hexane diol, 1,2-octane diol, 2,2,4-trimethyl-1,3-pentane diol, 1,8-octane diol, glycerol, 1,2,6-hexanetriol, 2-ethyl-2-hydroxymethyl-propane diol, saccharides and sugar alcohols, and thioglycol; (3) lower mono- and di-alkyl ethers derived from the polyhydric alcohols such as, ethylene glycol monomethyl ether, ethylene glycol monobutyl ether, ethylene glycol monoethyl ether acetate, diethylene glycol monomethyl ether, diethylene glycol monobutyl ether, polyethylene glycol monobutyl ether, and diethylene glycol monobutyl ether acetate; (4) nitrogen-containing compounds such as urea, 2-pyrrolidone, N-methyl-2-pyrrolidone, and 1,3-dimethyl-2-imidazolidinone; and (5) sulfur-containing compounds such as 2,2'-thiodiethanol, dimethyl sulfoxide and tetramethylene sulfone. Typical aqueous-based ink compositions useful in the invention may contain, for example, the following components based on the total weight of the ink: water 20-95%, humectant(s) 5-70%, and co-solvent(s) 2-20%.

Further embodiments of the inkjet recording ink employed in the invention may provide, among other attributes, improved color density, gloss, ink capacity, image permanence, adhesion to the support or underlying layers, and water-fastness. In addition, the ink may provide improved resistance to banding, differential gloss, coalescence, bleed, fade due to light, heat, or exposures to atmospheric gases, for example ozone, high humidity bleeding, abrasion resistance, and yellowing.

Inkjet printing systems useful in the invention comprise a printer, at least one ink, and an image recording element, typically a sheet (herein also "media"), suitable for receiving ink from an inkjet printer. Inkjet printing is a non-impact method for producing printed images by the deposition of ink droplets in a pixel-by-pixel manner to an image-recording element in response to digital data signals. There are various methods that may be utilized to control the deposition of ink droplets on the image-recording element to yield the desired printed image. In one process, known as drop-on-demand inkjet, individual ink droplets are projected as needed onto the image-recording element to form the desired printed image. Common methods of controlling the projection of ink droplets in drop-on-demand printing include piezoelectric transducers, thermal bubble formation, or an actuator that is made to move.

Drop-on-demand (DOD) liquid emission devices have been known as ink printing devices in inkjet printing systems for many years. Early devices were based on piezoelectric actuators such as are disclosed in U.S. Pat. Nos. 3,946,398 and 3,747,120. A currently popular form of inkjet printing, thermal inkjet (or "thermal bubble jet"), uses electrically resistive heaters to generate vapor bubbles which cause drop emission, as is discussed in U.S. Pat. No. 4,296,421. In another process, known as continuous inkjet, a continuous stream of droplets is generated, a portion of which are deflected in an image-wise manner onto the surface of the image-recording element, while un-imaged droplets are caught and returned to an ink sump. Continuous inkjet printers are disclosed in U.S. Pat. Nos. 6,588,888; 6,554,410; 6,682,182; 6,793,328; 6,866,370; 6,575,566; and 6,517,197.

FIG. 1 shows one schematic example of an inkjet printer 10 that includes a protective cover 40 for the internal components of the printer. The printer contains a media supply 20 in a tray. The printer includes one or more ink tanks 18 (shown here as having four inks) that supply ink to a printhead 30. The printhead 30 and ink tanks 18 are mounted on a carriage 100. The printer includes a source of image data 12 that provides signals that are interpreted by a controller (not shown) as being commands to eject drops of ink from the printhead 30. Printheads may be integral with the ink tanks or separate. Exemplary printheads are described in U.S. Pat. No. 7,350,902. In a typical printing operation a media sheet travels from the recording medium supply 20 in a media supply tray to a region where the printhead 30 deposits droplets of ink onto the media sheet. The printed media collection 22 is accumulated in an output tray.

Figure 2:
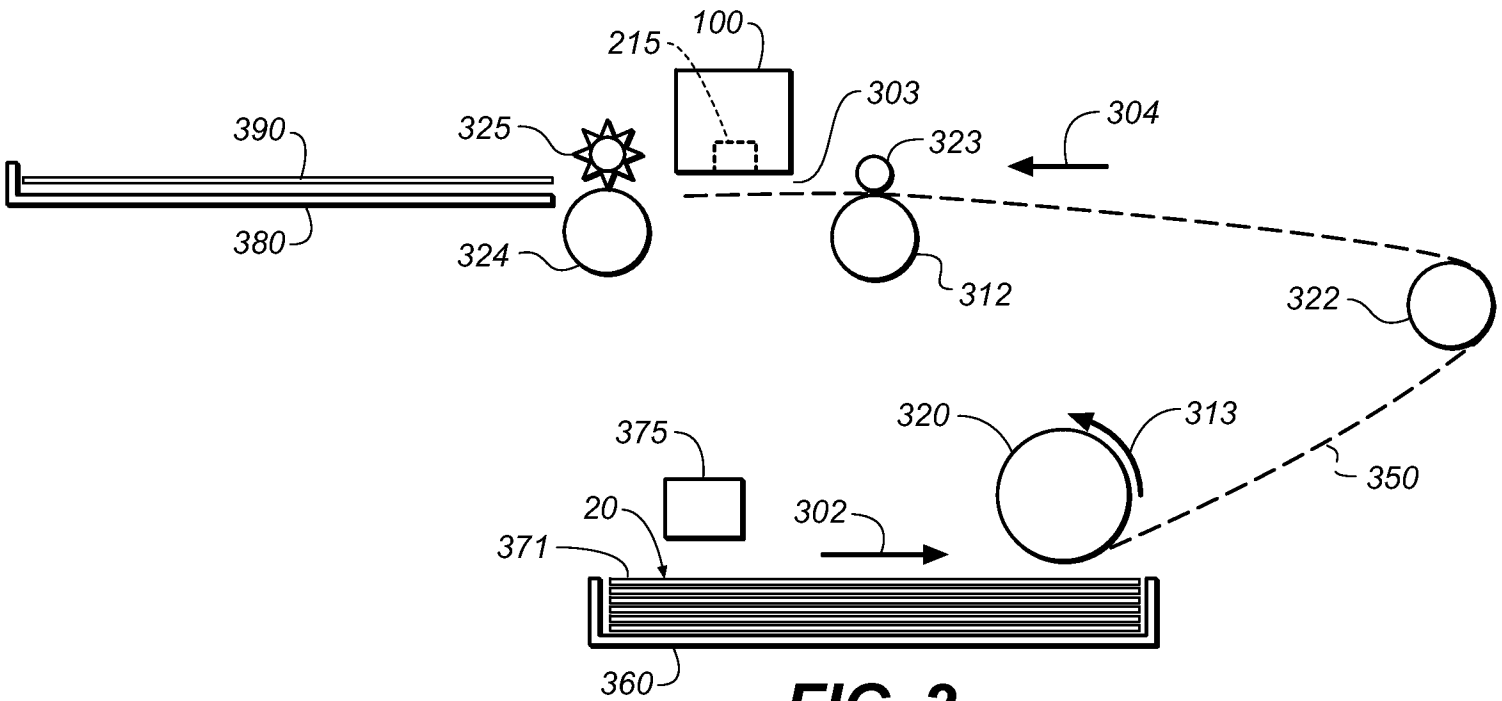
FIG. 2 is a schematic diagram showing the flow of recording element or media from the supply tray to the collection tray.

FIG. 2 shows schematically how the inkjet printer comprises a variety of rollers to advance the media sheet, for example paper, through the printer, as shown schematically in the side view of FIG. 2. In this example, a pickup roller 320 moves the top media sheet 371 of a recording medium supply 20 that is located in a media supply tray 360 in the direction of arrow 302. A turn roller 322 acts to move the media sheet 371 around a C-shaped path 350 (in cooperation with a curved surface-not shown) so that the media sheet continues to advance along direction arrow 304 in the printer. The media sheet 371 is then moved by feed roller 312 and idler roller(s) 323 to advance along direction 304 across the print region 303 and under printer carriage 100. A discharge roller 324 and star wheel(s) 325 transport the printed media sheet 390 along direction 304 and to an output tray 380. For normal media pick-up and feeding, it is desired that all driven rollers rotate in forward direction 313. An optional sensor 215 capable of detecting properties of the media sheet or indicia contained thereon can be mounted on the carriage 100. A further optional sensor 375 capable of detecting properties of the media sheet or indicia contained thereon may be positioned facing the front or back surface of the media sheet 371 and located at any advantageous position along the media transport path 350 including the media supply tray 360. Alternatively, the inkjet printing system comprises a printer supplied with a continuous roll of ink recording medium that may be cut to individual prints subsequent to printing.

Different types of image-recording elements (media) vary widely in their ability to absorb ink. Inkjet printing systems provide a number of different print modes designed for specific media types. A print mode is a set of rules for determining the amount, placement, and timing of the jetting of ink droplets during the printing operation. For optimal image reproduction in inkjet printing, the printing system must match the supplied media type with the correct print mode. The printing system may rely on the user interface to receive the identity of the supplied media, or an automated media detection system may be employed. A media detection system comprises a media detector, signal conditioning procedures, and an algorithm or look-up table to decide the media identity. The media detector may be configured to sense indicia present on the media comprising logos, patterns, and the like corresponding to media type, or may be configured to detect inherent media properties, typically optical reflection. The media detector may be located in a position to view either the front or back of the media sheet, depending on the property being detected. As exemplified in FIG. 2, the media detector 375 may be located to view the media sheet 371 in the media supply tray 360 or along the media transport path 350. Alternatively, optical sensor 215 may be located at the print region 303. Usefully, the media comprise a repeating pattern detectable by the method described in U.S. Pat. No. 7,120,272. Alternatively, a number of media detection methods are described in U.S. Pat. No. 6,585,341.

Figure 3:
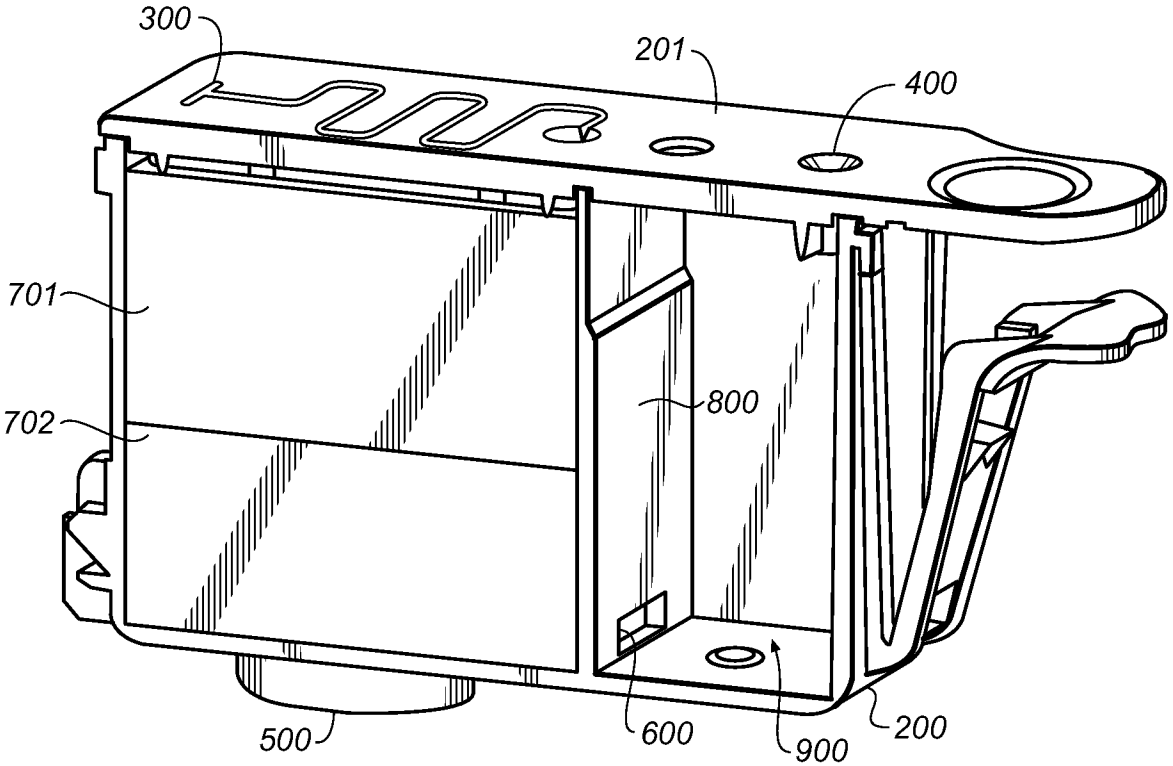
FIGS. 3-5 are illustrations of ink tanks which may be employed in embodiments of the invention.
Figure 4:
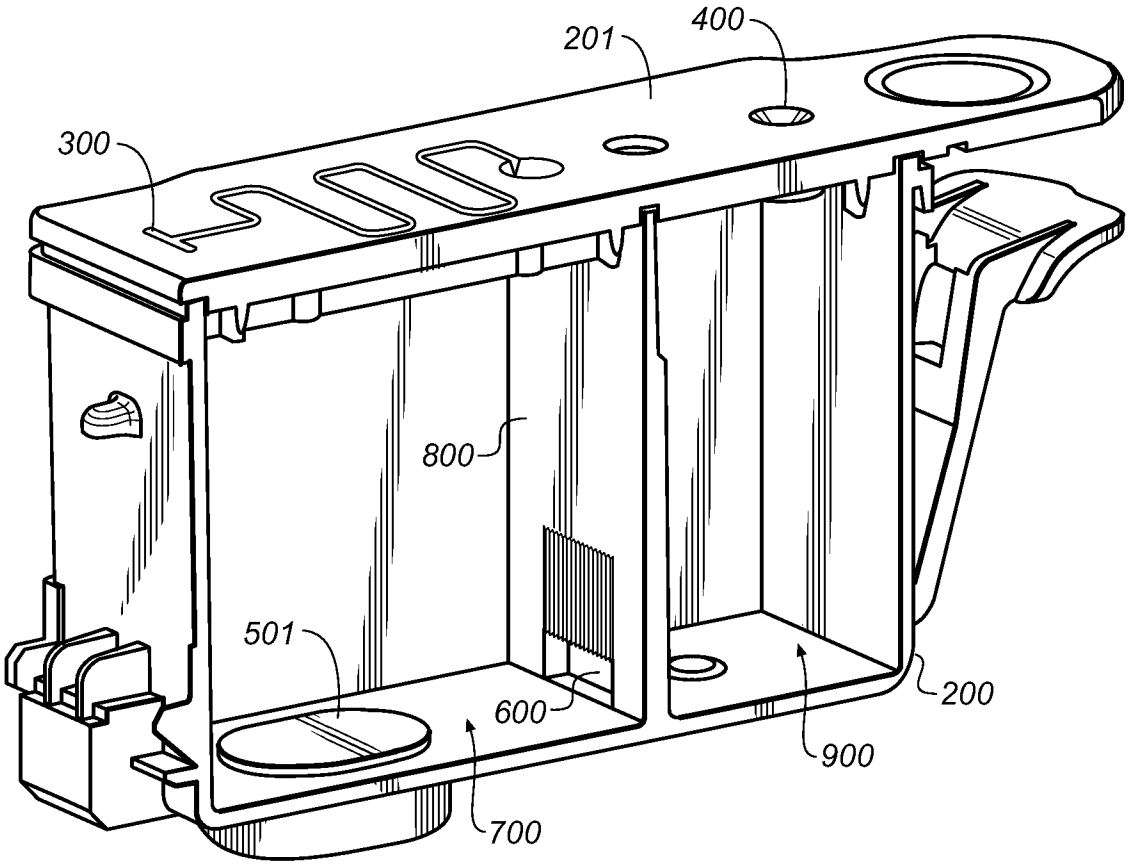
Figure 5:
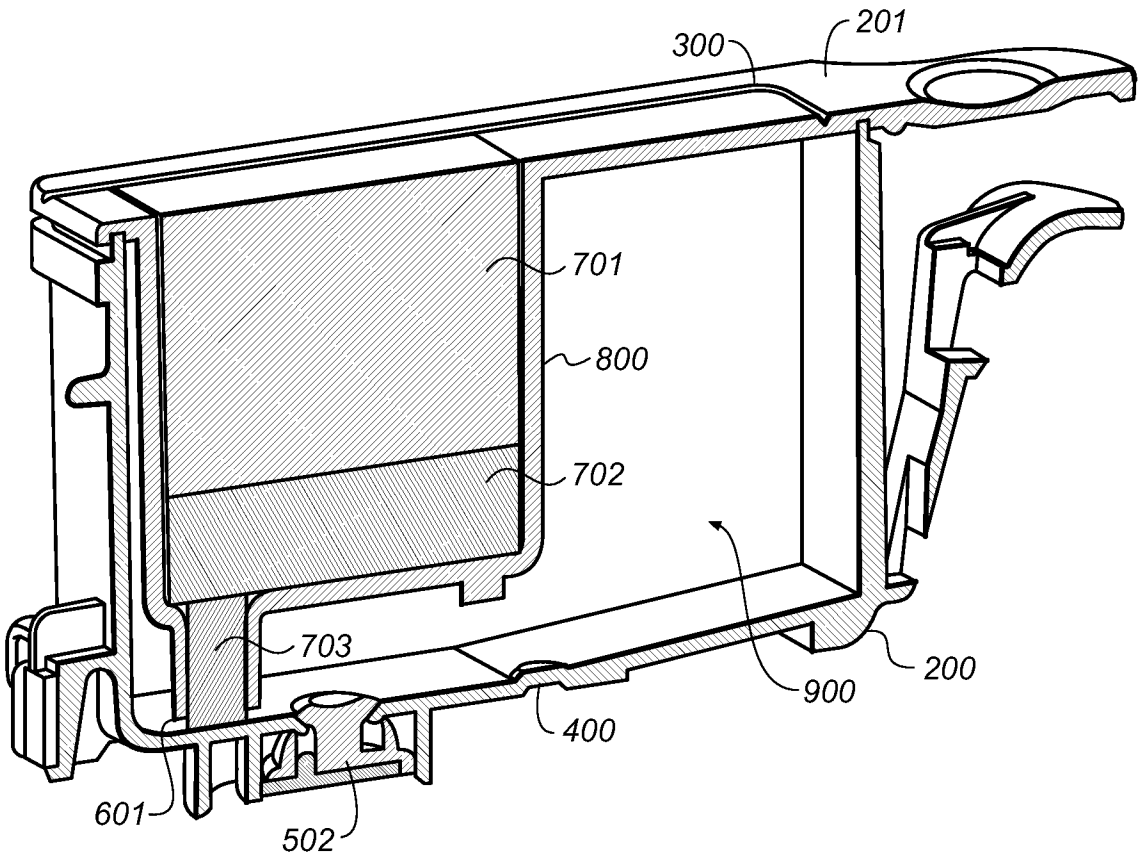

Ink tanks employed in the present invention comprise a free ink compartment in addition to a capillary media compartment which is vented to the atmosphere and in fluid communication with ink in the free ink compartment. Such ink tanks are exemplified by FIGS. 3 through 5. FIGS. 3 and 4 represent a conventional bubbler design and FIG. 5 is a reverse bubbler design. The main difference between the two designs is the relative position of the ink drain port relative to the back-pressure capillary media compartment. In the case of the bubbler design (see FIGS. 3 and 4), the drain port 500 contains a capillary wick 501 and is in contact with the back pressure capillary media 701 and 702. In the case of the reverse bubbler design (see FIG. 5), the drain port is a valve 502 that is in contact with free ink. In both cases, the back pressure capillary media vents to the atmosphere through a tank vent 300. Multiple layers of capillary media may be used with the same or different effective pore size. Two different media are shown in FIG. 3 (701 and 702) while three are shown in FIG. 5 (701, 702, and 703).

FIG. 3 contains a drawing of a bubbler tank. The tank body 200 and top 201 form an integrated enclosure for the ink. The ink fill hole 400 is sealed from the outside atmosphere after the filling process is completed. The free ink chamber 900 of the tank is separated from the capillary media chamber by a barrier wall 800. During ink withdrawal, air bubbles travel from the vent hole 300 to the access port 600 through the capillary media 701 & 702. The ink in the tank flows to the inkjet pen via an intermediate manifold (not shown) that docks with the ink tank via the drain port 500.

FIG. 4 is another view of the bubbler tank with the capillary media removed to allow a better view of the capillary wick 501 and chamber access port 600. Relative to FIG. 3, the capillary media 701 and 702 are positioned within the ink chamber 700.

FIG. 5 contains a drawing of a reverse bubbler tank. The tank body 200 and top 201 form an integrated enclosure for the ink. The ink fill hole 400 is sealed from the outside atmosphere after the filling process is completed. The free ink chamber 900 of the tank is separated from the capillary media chamber by a barrier wall 800. During ink withdrawal, air bubbles travel from the vent hole 300 to the access port 601 through the capillary media 703. The ink in the tank flows to the inkjet pen via an intermediate manifold (not shown) that docks with the ink tank via the drain port valve 502.

Any of the known capillary media types can be used for the capillary media members 701, 702, 703. Suitable materials include; foams, felts or fibers. Foams useful as capillary media members can be made from synthetic materials such as, for example; polyurethanes, polyesters, polystyrenes, polyvinylalcohol, polyethers, neoprene, and polyolefins. Fibers or felts useful as capillary media members can be made from synthetic materials such as, for example; cellulosics, polyurethanes, polyesters, polyamides, polyacrylates, polyolefins, such as polyethylene, polypropylene, or polybutylene, polyacrylonitrile, or copolymers thereof. Additional examples of capillary media member materials are exemplified in PCT International Publication Number WO 2007/138624, which is incorporated herein in its entirety by reference.

In bubbler tanks such as illustrated in FIGS. 3-5, it is desired that negative pressure rise slowly in the free ink side of the tank without large pressure change spikes due to inconsistent bubble passage into the free ink side as ink is extracted from the tank, followed by a gradual decline in negative pressure until the free ink side runs out of ink, as relatively large, sharp changes in negative pressure during ink extraction due to inconsistent bubble passage may undesirably impact performance of the inkjet printer. Use of an ink having a static surface tension of 37.5 dynes/cm in accordance with the present invention has been found to advantageously provide such desired good bubbler tank performance.

EXAMPLES

The following examples illustrate, but do not limit, the utility of the present invention.

Example 1

The following example shows the operating limits of surface tension for inks used in the bubbler tank design. The tanks were composed of a transparent polyethylene material and the inks were designed without pigment such that bubbles internal to the tank could be viewed during operation.

Ink Tank

The bubbler ink tank design is shown in FIGS. 3-4. The drain port capillary wick material 501, the bottom capillary material 702, and the upper capillary material 701 were each composed of PET/PP sheath/core fiber felts, with the upper capillary material 701 having the lowest density (0.11 g/cc, corresponding to the largest relative porosity and lowest relative capillarity) and the wick material 501 having the highest density (0.19 g/cc, corresponding to the lowest relative porosity and highest relative capillarity) of the three felts, with the lower capillary material 702 having an intermediate density (0.12 g/cc, corresponding to an intermediate relative porosity and capillarity).

Polymer P1

In a 1-liter, three-necked round-bottom flask equipped with a reflux condenser were mixed under nitrogen atmosphere 67 g of benzyl methacrylate, 33 g of methacrylic acid, 4.5 g of 1-dodecanethiol, and 400 mL of methyl ethyl ketone. The solution was stirred and purged with nitrogen for 20 minutes and heated to 70° C. in a constant temperature bath; 1.7 g. of Azobisisobutyronitrile (AIBN) was added. After 24 hours, the resulting solution was cooled. The resulting polymer solution was mixed with water and potassium hydroxide to achieve 85% acid neutralization. Thereafter the whole mixture was distilled at 50° C. under reduced pressure to remove the organic solvent. The final water-soluble polymer solution had a concentration of ca. 20 wt. % in water and its pH was ca. 8.5. The number average molecular weight was 5040 and the weight average molecular weight was 8860, and the calculated acid number was 215.

Ink 1A

This ink was composed of 8 wt. % glycerol, 12 wt. % triethyleneglycol, and 0.4 wt. % of Polymer P1. The remainder of the ink was water. It had a static surface tension of 42.9 dyne/cm at room temperature (25° C.). 15.0 mL of this ink was loaded into each of three separate bubbler ink tanks of the type generally illustrated in FIGS. 3-4.

Ink 1B

This ink was composed similarly to Ink 1A except that 0.05 wt. % of Tergitol 15-S-12 surfactant was added. It had a static surface tension of 38.3 dyne/cm at room temperature (25° C.). 15.0 mL of this ink was loaded into each of three separate bubbler ink tanks of the type generally illustrated in FIGS. 3-4.

Ink 1C

This ink was composed similarly to Ink 1A except that 0.05 wt. % of Strodex PK-90 surfactant was added. It had a static surface tension of 36.3 dyne/cm at room temperature (25° C.). 15.0 mL of this ink was loaded into each of three separate bubbler ink tanks of the type generally illustrated in FIGS. 3-4.

Ink 1D

This ink was composed similarly to Ink 1A except that 0.40 wt. % of Tergitol 15-S-12 surfactant was added. It had a static surface tension of 34.7 dyne/cm at room temperature (25° C.). 15.0 mL of this ink was loaded into each of three separate bubbler ink tanks of the type generally illustrated in FIGS. 3-4.

A flow loop was constructed with a peristaltic pump connected to a tank drain port capillary wick 501 via a coupling adapter. Ink was extracted from a tank at a rate of 2 mL/min over the course of 8 minutes. The pressure in the free ink side 900 of the tank was monitored with a pressure transducer connected to a computer via an A/D converter and interface. The pressure was monitored continuously several times a second over the course of pumping. A desirable pressure profile consisted of a slow rise in negative pressure for about 90 seconds followed by a gradual decline in negative pressure until the free ink side ran out of ink. An undesirable pressure profile consisted of a bumpy trace where the pressure would inconsistently rise before some bubbles were released. The number and average magnitude of the pressure spikes were calculated during each extraction and averaged over the three separate ink tanks for each ink. The time until the first bubble was released to the free ink side was also measured, and a standard deviation between the three tanks was calculated. The results are summarized in Table 1.

TABLE 1

Ink tank extraction summary

| ink | surface tension | mean # spikes per run | mean spike pressure | first bubble std. dev. time | tank performance |
|---|---|---|---|---|---|
| 1A | 42.9 | 6.7 | 36.9 | 30.3 | poor |
| 1B | 38.3 | 2.7 | 40.9 | 11.2 | poor |
| 1C | 36.3 | 0.7 | 4.5 | 12.9 | good |
| 1D | 34.7 | 0.3 | 2.0 | 6.8 | good |

The data in the table clearly show a decrease in the number and magnitude of pressure spikes as the surface tension was lowered below 38.3 dyne/cm. The first bubble uniformity was improved for inks with surface tension below 42.9 dyne/cm. There was a strong break in overall tank performance between inks 1B and 1C.

Example 2

Ink Preparation

Comparative Ink 2C-1

To prepare Ink 2C-1, 29.0 g of self-dispersed carbon black K4 from Orient Chemical Industries Corporation (13.8 wt % active), 12 g of triethylene glycol, 8 g of glycerol, 2.0 g of water soluble polymer P1 solution (20% active), and 2.8 g potassium carbonate solution (5% active) were added together with distilled water so that the final weight of the ink was 100.0 g. Dispersion K4 is very similar to commercial Orient CW-3 carbon pigment except that the particle size is larger and the amount of surface functional group has been increased to a higher treatment level. The volatile surface functional groups for this dispersion were measured to be 22.1 wt. %. The final ink contained 4.0% carbon 12% triethylene glycol, 8% glycerol, and 0.4% water-soluble polymer P1. The solution was filtered through a 1.2 μm polytetrafluoroethylene filter. The resulting ink had the following physical properties: a surface tension of 45.5 dynes/cm at room temperature (25° C.), a viscosity of 2.16 cps at room temperature, and a pH of 8.76. The 50% intensity mode particle size of the ink was about 139 nm as measured by MICROTRAC II Ultrafine particle analyzer (UPA) manufactured by Leeds & Northrup.

Comparative Ink 2C-2

Comparative ink 2C-2 was prepared similarly to ink 2C-1 except that 0.5 g of Tergitol 15-S-12 (diluted to 10 wt %) from Dow Chemical Corporation was added. The final ink contained 4.0% carbon 12% triethylene glycol, 8% glycerol, 0.4% water-soluble polymer P1, and 0.05% Tergitol 15-S-12. The solution was filtered through a 1.2 μm polytetrafluoroethylene filter. The resulting ink had the following physical properties: a surface tension of 38.6 dynes/cm at room temperature, a viscosity of 2.14 cps at room temperature, and a pH of 8.73. The 50% intensity mode particle size of the ink was about 138 nm as measured by MICROTRAC II Ultrafine particle analyzer (UPA) manufactured by Leeds & Northrup.

Inventive Ink 2I-1

Inventive ink 2I-1 was prepared similarly to ink 2C-2 except that 1.0 g of Tergitol 15-S-12 (diluted to 10 wt %) from Dow Chemical Corporation was added. The final ink contained 4.0% carbon 12% triethylene glycol, 8% glycerol, 0.4% water-soluble polymer P1, and 0.1% Tergitol 15-S-12. The solution was filtered through a 1.2 μm polytetrafluoroethylene filter. The resulting ink had the following physical properties: a surface tension of 37.3 dynes/cm at room temperature, a viscosity of 2.14 cps at room temperature, and a pH of 8.74. The 50% intensity mode particle size of the ink was about 139 nm as measured by MICROTRAC II Ultrafine particle analyzer (UPA) manufactured by Leeds & Northrup.

Comparative Ink 2C-3

Comparative ink 2C-3 was prepared similarly to ink 2C-2 except that 2.0 g of Tergitol 15-S-12 (diluted to 10 wt %) from Dow Chemical Corporation was added. The final ink contained 4.0% carbon 12% triethylene glycol, 8% glycerol, 0.4% water-soluble polymer P1, and 0.2% Tergitol 15-S-12. The solution was filtered through a 1.2 μm polytetrafluoroethylene filter. The resulting ink had the following physical properties: a surface tension of 35.4 dynes/cm at room temperature, a viscosity of 2.17 cps at room temperature, and a pH of 8.75. The 50% intensity mode particle size of the ink was about 139 nm as measured by MICROTRAC II Ultrafine particle analyzer (UPA) manufactured by Leeds & Northrup.

Comparative Ink 2C-4

Comparative ink 2C-4 was prepared similarly to ink 2C-2 except that 4.0 g of Tergitol 15-S-12 (diluted to 10 wt %) from Dow Chemical Corporation was added. The final ink contained 4.0% carbon 12% triethylene glycol, 8% glycerol, 0.4% water-soluble polymer P1, and 0.4% Tergitol 15-S-12. The solution was filtered through a 1.2 μm polytetrafluoroethylene filter. The resulting ink had the following physical properties: a surface tension of 34.8 dynes/cm at room temperature, a viscosity of 2.20 cps at room temperature, and a pH of 8.76. The 50% intensity mode particle size of the ink was about 136 nm as measured by MICROTRAC II Ultrafine particle analyzer (UPA) manufactured by Leeds & Northrup.

Comparative Ink 2C-5

Comparative ink 2C-5 was prepared similarly to ink 2C-1 except that 0.5 g of Tergitol 15-S-20 (diluted to 10 wt %) from Dow Chemical Corporation was added. The final ink contained 4.0% carbon 12% triethylene glycol, 8% glycerol, 0.4% water-soluble polymer P1, and 0.05% Tergitol 15-S-20. The solution was filtered through a 1.2 μm polytetrafluoroethylene filter. The resulting ink had the following physical properties: a surface tension of 40.9 dynes/cm at room temperature, a viscosity of 2.15 cps at room temperature, and a pH of 8.73. The 50% intensity mode particle size of the ink was about 139 nm as measured by MICROTRAC II Ultrafine particle analyzer (UPA) manufactured by Leeds & Northrup.

Comparative Ink 2C-6

Comparative ink 2C-6 was prepared similarly to ink 2C-5 except that 1.0 g of Tergitol 15-S-20 (diluted to 10 wt %) from Dow Chemical Corporation was added. The final ink contained 4.0% carbon 12% triethylene glycol, 8% glycerol, 0.4% water-soluble polymer P1, and 0.1% Tergitol 15-S-20. The solution was filtered through a 1.2 μm polytetrafluoroethylene filter. The resulting ink had the following physical properties: a surface tension of 39.9 dynes/cm at room temperature, a viscosity of 2.16 cps at room temperature, and a pH of 8.74. The 50% intensity mode particle size of the ink was about 138 nm as measured by MICROTRAC II Ultrafine particle analyzer (UPA) manufactured by Leeds & Northrup.

Comparative Ink 2C-7

Comparative ink 2C-7 was prepared similarly to ink 2C-5 except that 2.0 g of Tergitol 15-S-20 (diluted to 10 wt %) from Dow Chemical Corporation was added. The final ink contained 4.0% carbon 12% triethylene glycol, 8% glycerol, 0.4% water-soluble polymer P1, and 0.2% Tergitol 15-S-20. The solution was filtered through a 1.2 μm polytetrafluoroethylene filter. The resulting ink had the following physical properties: a surface tension of 39.3 dynes/cm at room temperature, a viscosity of 2.18 cps at room temperature, and a pH of 8.76. The 50% intensity mode particle size of the ink was about 139 nm as measured by MICROTRAC II Ultrafine particle analyzer (UPA) manufactured by Leeds & Northrup.

Comparative Ink 2C-8

Comparative ink 2C-8 was prepared similarly to ink 2C-5 except that 4.0 g of Tergitol 15-S-20 (diluted to 10 wt %) from Dow Chemical Corporation was added. The final ink contained 4.0% carbon 12% triethylene glycol, 8% glycerol, 0.4% water-soluble polymer P1, and 0.4% Tergitol 15-S-20. The solution was filtered through a 1.2 μm polytetrafluoroethylene filter. The resulting ink had the following physical properties: a surface tension of 38.5 dynes/cm at room temperature, a viscosity of 2.22 cps at room temperature, and a pH of 8.76. The 50% intensity mode particle size of the ink was about 138 nm as measured by MICROTRAC II Ultrafine particle analyzer (UPA) manufactured by Leeds & Northrup.

Inventive Ink 2I-2

Inventive ink 2I-2 was prepared similarly to ink 2C-1 except that 0.5 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.05% Strodex PK-90. The solution was filtered through a 1.2 μm polytetrafluoroethylene filter. The resulting ink had the following physical properties: a surface tension of 34.7 dynes/cm at room temperature, a viscosity of 2.14 cps at room temperature, and a pH of 8.73. The 50% intensity mode particle size of the ink was about 139 nm as measured by MICROTRAC II Ultrafine particle analyzer (UPA) manufactured by Leeds & Northrup.

Inventive Ink 2I-3

Inventive ink 2I-3 was prepared similarly to ink 2C-1 except that 0.125 g of Zonyl FSO (diluted to 10 wt %) from E.I. du Pont de Nemours and Company was added. The final ink contained 4.0% carbon 12% triethylene glycol, 8% glycerol, 0.4% water-soluble polymer P1, and 0.0125% Zonyl FSO. The solution was filtered through a 1.2 μm polytetrafluoroethylene filter. The resulting ink had the following physical properties: a surface tension of 23.3 dynes/cm at room temperature, a viscosity of 2.18 cps at room temperature, and a pH of 8.76. The 50% intensity mode particle size of the ink was about 139 nm as measured by MICROTRAC II Ultrafine particle analyzer (UPA) manufactured by Leeds & Northrup.

System Test Printing Evaluation

All fresh inks of Example 2 were filled into printer compatible empty text black cartridges and printed along with ink from a color ink cartridge containing photo black, yellow, magenta and cyan pigmented inks with a Kodak 5300 thermal ink jet printer. After priming, a nozzle check target was printed to establish that all nozzles of all colors were firing properly. Then two full 8.5" by 11" pages were uniformly printed using just the text black channel at an ink laydown that represented 70% of the maximum laydown. After that, a test target was printed in a 2 pass, bidirectional mode on 4 plain papers. The test target contained a bar chart of all five pigmented ink channels (text black, photo black, yellow, magenta, and cyan) as well as the secondary primaries (red, green, and blue). For the text black channel, a solid area of 0.5 inch by 2.5 inch at 100% dot coverage was printed. The Status A reflection density of the printed black patch was measured on the visual channel using a SpectroScan densitometer manufactured by GreytagMacbeth. The 4 papers used for evaluation were: 1) Hammermill Great White Copy Paper item 86700, 2) Georgia Pacific Premium Multi-Use Paper item 999707, 3) Xerox Mutipurpose Paper item 3R11029, and 4) Staples 30% Recycled Paper item 492071.

Table 2 lists the results for the Example 2 experiments. Listed in the table is the ink designation, the surfactant in each ink, the concentration of surfactant, the measured surface tension, the average printed visual density for the four papers used, and the bubbler tank performance as determined in Example 1 based on the measured surface tension.

TABLE 2

Example 2 results

| ink | surfactant | % surfactant | surface tension | Printed Visual Density | tank performance |
|---|---|---|---|---|---|
| 2C-1 | none | 0.00% | 45.5 | 1.61 | poor |
| 2C-2 | 15-S-12 | 0.05% | 38.6 | 1.56 | poor |
| 2I-1 | 15-S-12 | 0.10% | 37.3 | 1.51 | good |
| 2C-3 | 15-S-12 | 0.20% | 35.4 | 1.46 | good |
| 2C-4 | 15-S-12 | 0.40% | 34.8 | 1.40 | good |
| 2C-5 | 15-S-20 | 0.05% | 40.9 | 1.56 | poor |
| 2C-6 | 15-S-20 | 0.10% | 39.9 | 1.52 | poor |
| 2C-7 | 15-S-20 | 0.20% | 39.3 | 1.51 | poor |
| 2C-8 | 15-S-20 | 0.40% | 38.5 | 1.47 | poor |
| 2I-2 | PK-90 | 0.05% | 34.7 | 1.54 | good |
| 2I-3 | FSO | 0.0125% | 23.3 | 1.56 | good |

The results show that both higher printed density and good bubbler tank performance are achieved when the surface tension is less than 37.5 dynes/cm and the surfactant concentration is less than or equal to 0.10%.

Example 3

Ink Preparation

All of the inks in this example were prepared exactly as in Example 2 except that the level of triethylene glycol in each ink was increased to 16%.

Comparative Ink 3C-1

To prepare Ink 3C-1, 29.0 g of self-dispersed carbon black K4 from Orient Chemical Industries Corporation (13.8 wt % active), 16 g of triethylene glycol, 8 g of glycerol, 2.0 g of water soluble polymer P1 solution (20% active), and 2.8 g potassium carbonate solution (5% active) were added together with distilled water so that the final weight of the ink was 100.0 g. The volatile surface functional groups for this dispersion were measured to be 22.1 wt. %. The final ink contained 4.0% carbon 16% triethylene glycol, 8% glycerol, and 0.4% water-soluble polymer P1. The solution was filtered through a 1.2 μm polytetrafluoroethylene filter. The resulting ink had the following physical properties: a surface tension of 44.3 dynes/cm at room temperature, a viscosity of 2.49 cps at room temperature, and a pH of 8.68. The 50% intensity mode particle size of the ink was about 134 nm as measured by MICROTRAC II Ultrafine particle analyzer (UPA) manufactured by Leeds & Northrup.

Comparative Ink 3C-2

Comparative ink 3C-2 was prepared similarly to ink 3C-1 except that 0.5 g of Tergitol 15-S-12 (diluted to 10 wt %) from Dow Chemical Corporation was added. The final ink contained 4.0% carbon 16% triethylene glycol, 8% glycerol, 0.4% water-soluble polymer P1, and 0.05% Tergitol 15-S-12. The solution was filtered through a 1.2 μm polytetrafluoroethylene filter. The resulting ink had the following physical properties: a surface tension of 37.6 dynes/cm at room temperature, a viscosity of 2.50 cps at room temperature, and a pH of 8.67. The 50% intensity mode particle size of the ink was about 136 nm as measured by MICROTRAC II Ultrafine particle analyzer (UPA) manufactured by Leeds & Northrup.

Inventive Ink 3I-1

Inventive ink 3I-1 was prepared similarly to ink 3C-2 except that 1.0 g of Tergitol 15-S-12 (diluted to 10 wt %) from Dow Chemical Corporation was added. The final ink contained 4.0% carbon 16% triethylene glycol, 8% glycerol, 0.4% water-soluble polymer P1, and 0.1% Tergitol 15-S-12. The solution was filtered through a 1.2 μm polytetrafluoroethylene filter. The resulting ink had the following physical properties: a surface tension of 36.9 dynes/cm at room temperature, a viscosity of 2.50 cps at room temperature, and a pH of 8.68. The 50% intensity mode particle size of the ink was about 137 nm as measured by MICROTRAC II Ultrafine particle analyzer (UPA) manufactured by Leeds & Northrup.

Comparative Ink 3C-3

Comparative ink 3C-3 was prepared similarly to ink 3C-2 except that 2.0 g of Tergitol 15-S-12 (diluted to 10 wt %) from Dow Chemical Corporation was added. The final ink contained 4.0% carbon 16% triethylene glycol, 8% glycerol, 0.4% water-soluble polymer P1, and 0.2% Tergitol 15-S-12. The solution was filtered through a 1.2 μm polytetrafluoroethylene filter. The resulting ink had the following physical properties: a surface tension of 36.0 dynes/cm at room temperature, a viscosity of 2.52 cps at room temperature, and a pH of 8.69. The 50% intensity mode particle size of the ink was about 138 nm as measured by MICROTRAC II Ultrafine particle analyzer (UPA) manufactured by Leeds & Northrup.

Comparative Ink 3C-4

Comparative ink 3C-4 was prepared similarly to ink 3C-2 except that 4.0 g of Tergitol 15-S-12 (diluted to 10 wt %) from Dow Chemical Corporation was added. The final ink contained 4.0% carbon 16% triethylene glycol, 8% glycerol, 0.4% water-soluble polymer P1, and 0.4% Tergitol 15-S-12. The solution was filtered through a 1.2 μm polytetrafluoroethylene filter. The resulting ink had the following physical properties: a surface tension of 34.4 dynes/cm at room temperature, a viscosity of 2.57 cps at room temperature, and a pH of 8.70. The 50% intensity mode particle size of the ink was about 139 nm as measured by MICROTRAC II Ultrafine particle analyzer (UPA) manufactured by Leeds & Northrup.

Comparative Ink 3C-5

Comparative ink 3C-5 was prepared similarly to ink 3C-1 except that 0.5 g of Tergitol 15-S-20 (diluted to 10 wt %) from Dow Chemical Corporation was added. The final ink contained 4.0% carbon 16% triethylene glycol, 8% glycerol, 0.4% water-soluble polymer P1, and 0.05% Tergitol 15-S-20. The solution was filtered through a 1.2 μm polytetrafluoroethylene filter. The resulting ink had the following physical properties: a surface tension of 40.5 dynes/cm at room temperature, a viscosity of 2.57 cps at room temperature, and a pH of 8.68. The 50% intensity mode particle size of the ink was about 138 nm as measured by MICROTRAC II Ultrafine particle analyzer (UPA) manufactured by Leeds & Northrup.

Comparative Ink 3C-6

Comparative ink 3C-6 was prepared similarly to ink 3C-5 except that 1.0 g of Tergitol 15-S-20 (diluted to 10 wt %) from Dow Chemical Corporation was added. The final ink contained 4.0% carbon 16% triethylene glycol, 8% glycerol, 0.4% water-soluble polymer P1, and 0.1% Tergitol 15-S-20. The solution was filtered through a 1.2 μm polytetrafluoroethylene filter. The resulting ink had the following physical properties: a surface tension of 39.9 dynes/cm at room temperature, a viscosity of 2.51 cps at room temperature, and a pH of 8.68. The 50% intensity mode particle size of the ink was about 134 nm as measured by MICROTRAC II Ultrafine particle analyzer (UPA) manufactured by Leeds & Northrup.

Comparative Ink 3C-7

Comparative ink 3C-7 was prepared similarly to ink 3C-5 except that 2.0 g of Tergitol 15-S-20 (diluted to 10 wt %) from Dow Chemical Corporation was added. The final ink contained 4.0% carbon 16% triethylene glycol, 8% glycerol, 0.4% water-soluble polymer P1, and 0.2% Tergitol 15-S-20. The solution was filtered through a 1.2 μm polytetrafluoroethylene filter. The resulting ink had the following physical properties: a surface tension of 39.0 dynes/cm at room temperature, a viscosity of 2.54 cps at room temperature, and a pH of 8.69. The 50% intensity mode particle size of the ink was about 140 nm as measured by MICROTRAC II Ultrafine particle analyzer (UPA) manufactured by Leeds & Northrup.

Comparative Ink 3C-8

Comparative ink 3C-8 was prepared similarly to ink 3C-5 except that 4.0 g of Tergitol 15-S-20 (diluted to 10 wt %) from Dow Chemical Corporation was added. The final ink contained 4.0% carbon 16% triethylene glycol, 8% glycerol, 0.4% water-soluble polymer P1, and 0.4% Tergitol 15-S-20. The solution was filtered through a 1.2 μm polytetrafluoroethylene filter. The resulting ink had the following physical properties: a surface tension of 38.2 dynes/cm at room temperature, a viscosity of 2.59 cps at room temperature, and a pH of 8.71. The 50% intensity mode particle size of the ink was about 138 nm as measured by MICROTRAC II Ultrafine particle analyzer (UPA) manufactured by Leeds & Northrup.

Inventive Ink 3I-2

Inventive ink 3I-2 was prepared similarly to ink 3C-1 except that 0.5 g of Strodex PK-90 (diluted to 10 wt %) from Dexter Chemical Corporation was added. The final ink contained 4.0% carbon 16% triethylene glycol, 8% glycerol, 0.4% water-soluble polymer P1, and 0.05% Strodex PK-90. The solution was filtered through a 1.2 μm polytetrafluoroethylene filter. The resulting ink had the following physical properties: a surface tension of 34.8 dynes/cm at room temperature, a viscosity of 2.49 cps at room temperature, and a pH of 8.65. The 50% intensity mode particle size of the ink was about 139 nm as measured by MICROTRAC II Ultrafine particle analyzer (UPA) manufactured by Leeds & Northrup.

Inventive Ink 3I-3

Inventive ink 3I-3 was prepared similarly to ink 3C-1 except that 0.125 g of Zonyl FSO (diluted to 10 wt %) from E.I. du Pont de Nemours and Company was added. The final ink contained 4.0% carbon 16% triethylene glycol, 8% glycerol, 0.4% water-soluble polymer P1, and 0.0125% Zonyl FSO. The solution was filtered through a 1.2 μm polytetrafluoroethylene filter. The resulting ink had the following physical properties: a surface tension of 23.9 dynes/cm at room temperature, a viscosity of 2.49 cps at room temperature, and a pH of 8.67. The 50% intensity mode particle size of the ink was about 139 nm as measured by MICROTRAC II Ultrafine particle analyzer (UPA) manufactured by Leeds & Northrup.

System Test Printing Evaluation

All fresh inks of Example 3 were filled into printer compatible empty text black cartridges and printed along with ink from a color ink cartridge containing photo black, yellow, magenta and cyan pigmented inks with a Kodak 5300 thermal ink jet printer. After priming, a nozzle check target was printed to establish that all nozzles of all colors were firing properly. Then two full 8.5" by 11" pages were uniformly printed using just the text black channel at an ink laydown that represented 70% of the maximum laydown. After that, a test target was printed in a 2 pass, bidirectional mode on 4 plain papers. The test target contained a bar chart of all five pigmented ink channels (text black, photo black, yellow, magenta, and cyan) as well as the secondary primaries (red, green, and blue). For the text black channel, a solid area of 0.5 inch by 2.5 inch at 100% dot coverage was printed. The Status A reflection density of the printed black patch was measured on the visual channel using a SpectroScan densitometer manufactured by GreytagMacbeth. The 4 papers used for evaluation were: 1) Hammermill Great White Copy Paper item 86700, 2) Georgia Pacific Premium Multi-Use Paper item 999707, 3) Xerox Mutipurpose Paper item 3R11029, and 4) Staples 30% Recycled Paper item 492071.

Table 3 lists the results for the Example 3 experiments. Listed in the table is the ink designation, the surfactant in each ink, the concentration of surfactant, the measured surface tension, the average printed visual density for the four papers used, and the bubbler tank performance as determined in Example 1 based on the measured surface tension.

TABLE 3

Example 3 results

| ink | surfactant | % surfactant | surface tension | Printed Visual Density | tank performance |
|---|---|---|---|---|---|
| 3C-1 | none | 0.00% | 44.3 | 1.60 | poor |
| 3C-2 | 15-S-12 | 0.05% | 37.6 | 1.55 | Poor |
| 3I-1 | 15-S-12 | 0.10% | 36.9 | 1.48 | good |
| 3C-3 | 15-S-12 | 0.20% | 36.0 | 1.44 | good |
| 3C-4 | 15-S-12 | 0.40% | 34.4 | 1.39 | good |
| 3C-5 | 15-S-20 | 0.05% | 40.5 | 1.56 | poor |
| 3C-6 | 15-S-20 | 0.10% | 39.9 | 1.54 | poor |
| 3C-7 | 15-S-20 | 0.20% | 39.0 | 1.52 | poor |
| 3C-8 | 15-S-20 | 0.40% | 38.2 | 1.44 | poor |
| 3I-2 | PK-90 | 0.05% | 34.8 | 1.55 | good |
| 3I-3 | FSO | 0.0125% | 22.9 | 1.56 | good |

These results at higher total humectant were consistent with the Example 2 results at lower humectant. They show that both high printed density and good bubbler tank performance are achieved when the surface tension is less than 37.5 dynes/cm and the surfactant concentration is less than or equal to 0.10%.

Example 4

Ink Preparation

Comparative Ink 4C-1

To prepare Ink 4C-1, 29.0 g of self-dispersed carbon black K4 from Orient Chemical Industries Corporation (13.8 wt % active), 12 g of triethylene glycol, 8 g of glycerol, 2.0 g of water soluble polymer P1 solution (20% active), 3.0 g of Strodex PK-90 (diluted to 10 wt %) from Dexter Chemical Corporation, and 2.8 g potassium carbonate solution (5% active) were added together with distilled water so that the final weight of the ink was 100.0 g. Dispersion K4 is very similar to commercial Orient CW-3 carbon pigment except that the particle size is larger and the amount of surface functional group has been increased to a higher treatment level. The volatile surface functional groups for this dispersion were measured to be 22.1 wt. %. The final ink contained 4.0% carbon 12% triethylene glycol, 8% glycerol, 0.4% water-soluble polymer P1, and 0.3% Strodex PK-90. The solution was filtered through a 1.2 μm polytetrafluoroethylene filter. The resulting ink had the following physical properties: a surface tension of 28.5 dynes/cm at room temperature, a viscosity of 2.14 cps at room temperature, and a pH of 8.42. The 50% intensity mode particle size of the ink was about 136 nm as measured by MICROTRAC II Ultrafine particle analyzer (UPA) manufactured by Leeds & Northrup.

Comparative Ink 4C-2

Comparative ink 4C-2 was prepared similarly to ink 4C-1 except that 2.0 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.2% Strodex PK-90. The solution was filtered through a 1.2 μm polytetrafluoroethylene filter. The resulting ink had the following physical properties: a surface tension of 30.1 dynes/cm at room temperature, a viscosity of 2.11 cps at room temperature, and a pH of 8.48. The 50% intensity mode particle size of the ink was about 141 nm as measured by MICROTRAC II Ultrafine particle analyzer (UPA) manufactured by Leeds & Northrup.

Inventive Ink 4I-1

Inventive ink 4I-1 was prepared similarly to ink 4C-1 except that 1.0 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.1% Strodex PK-90. The solution was filtered through a 1.2 μm polytetrafluoroethylene filter. The resulting ink had the following physical properties: a surface tension of 32.2 dynes/cm at room temperature, a viscosity of 2.10 cps at room temperature, and a pH of 8.43. The 50% intensity mode particle size of the ink was about 137 nm as measured by MICROTRAC II Ultrafine particle analyzer (UPA) manufactured by Leeds & Northrup.

System Test Printing Evaluation

All fresh inks of Example 4 were filled into printer compatible empty text black cartridges and printed along with ink from a color ink cartridge containing photo black, yellow, magenta and cyan pigmented inks with a Kodak 5250 thermal ink jet printer. The software for this printer laid down less ink than for the printer of Examples 2 and 3, so overall densities were lower. After priming, a nozzle check target was printed to establish that all nozzles of all colors were firing properly. Then two full 8.5" by 11" pages were uniformly printed using just the text black channel at an ink laydown that represented 70% of the maximum laydown. After that, a test target was printed in a 2 pass, bidirectional mode on 4 plain papers. The test target contained a bar chart of all five pigmented ink channels (text black, photo black, yellow, magenta, and cyan) as well as the secondary primaries (red, green, and blue). For the text black channel, a solid area of 0.5 inch by 2.5 inch at 100% dot coverage was printed. The Status A reflection density of the printed black patch was measured on the visual channel using a SpectroScan densitometer manufactured by GreytagMacbeth. The 4 papers used for evaluation were: 1) Hammermill Great White Copy Paper item 86700, 2) Georgia Pacific Premium Multi-Use Paper item 999707, 3) Xerox Mutipurpose Paper item 3R11029, and 4) Staples 30% Recycled Paper item 492071.

Table 4 lists the results for the Example 4 experiments. Listed in the table is the ink designation, the surfactant in each ink, the concentration of surfactant, the measured surface tension, the average printed visual density for the four papers used, and the bubbler tank performance as determined in Example 1 based on the measured surface tension.

TABLE 4

| Example 4 results | | | | | |
|---|---|---|---|---|---|
| ink | surfactant | % surfactant | surface tension | Printed Visual Density | tank performance |
| 4C-1 | PK-90 | 0.30% | 28.5 | 1.27 | good |
| 4C-2 | PK-90 | 0.20% | 30.1 | 1.27 | good |
| 4I-1 | PK-90 | 0.10% | 32.2 | 1.33 | good |

These results were consistent with the Example 2 and Example 3 results, even though the overall densities were lower due to a lower printed ink laydown. They show that both higher printed density and good bubbler tank performance are achieved when the surface tension is less than 37.5 dynes/cm and the surfactant concentration is less than or equal to 0.10%.

Example 5

Ink Preparation

Comparative Ink 5C-1

To prepare Ink 5C-1, 31.0 g of self-dispersed carbon black CW-3 pigment from Orient Chemical Industries Corporation (12.9 wt % active), 12 g of triethylene glycol, 8 g of glycerol, 2.0 g of water soluble polymer P1 solution (20% active), 0.2 g of Tergitol 15-S-12 (diluted to 10 wt %) from Dow Chemical Corporation, and 2.8 g potassium carbonate solution (5% active) were added together with distilled water so that the final weight of the ink was 100.0 g. The volatile surface functional groups for this dispersion were measured to be 14.6 wt. %. The final ink contained 4.0% carbon 12% triethylene glycol, 8% glycerol, 0.4% water-soluble polymer P1, and 0.02% Tergitol 15-S-12. The solution was filtered through a 1.2 μm polytetrafluoroethylene filter. The resulting ink had the following physical properties: a surface tension of 44.6 dynes/cm at room temperature, a viscosity of 2.08 cps at room temperature, and a pH of 7.75. The 50% intensity mode particle size of the ink was about 112 nm as measured by MICROTRAC II Ultrafine particle analyzer (UPA) manufactured by Leeds & Northrup.

Comparative Ink 5C-2

Comparative ink 5C-2 was prepared similarly to ink 5C-1 except that 0.8 g of Tergitol 15-S-12 (diluted to 10 wt %) from Dow Chemical Corporation was added. The final ink contained 4.0% carbon 12% triethylene glycol, 8% glycerol, 0.4% water-soluble polymer P1, and 0.08% Tergitol 15-S-12. The solution was filtered through a 1.2 μm polytetrafluoroethylene filter. The resulting ink had the following physical properties: a surface tension of 39.1 dynes/cm at room temperature, a viscosity of 2.08 cps at room temperature, and a pH of 7.69. The 50% intensity mode particle size of the ink was about 110 nm as measured by MICROTRAC II Ultrafine particle analyzer (UPA) manufactured by Leeds & Northrup.

Comparative Ink 5C-3

Comparative ink 5C-3 was prepared similarly to ink 5C-1 except that 1.4 g of Tergitol 15-S-12 (diluted to 10 wt %) from Dow Chemical Corporation was added. The final ink contained 4.0% carbon 12% triethylene glycol, 8% glycerol, 0.4% water-soluble polymer P1, and 0.14% Tergitol 15-S-12. The solution was filtered through a 1.2 μm polytetrafluoroethylene filter. The resulting ink had the following physical properties: a surface tension of 37.4 dynes/cm at room temperature, a viscosity of 2.10 cps at room temperature, and a pH of 7.69. The 50% intensity mode particle size of the ink was about 109 nm as measured by MICROTRAC II Ultrafine particle analyzer (UPA) manufactured by Leeds & Northrup.

Comparative Ink 5C-4

Comparative ink 5C-4 was prepared similarly to ink 5C-1 except that 0.2 g of Tergitol 15-S-3 (diluted to 10 wt %) from Dow Chemical Corporation was added in place of the Tergitol 15-S-12. The final ink contained 4.0% carbon 12% triethylene glycol, 8% glycerol, 0.4% water-soluble polymer P1, and 0.02% Tergitol 15-S-3. The solution was filtered through a 1.2 μm polytetrafluoroethylene filter. The resulting ink had the following physical properties: a surface tension of 38.2 dynes/cm at room temperature, a viscosity of 2.08 cps at room temperature, and a pH of 7.69. The 50% intensity mode particle size of the ink was about 112 nm as measured by MICROTRAC II Ultrafine particle analyzer (UPA) manufactured by Leeds & Northrup.

Inventive Ink 5I-1

Inventive ink 5I-1 was prepared similarly to ink 5C-4 except that 0.8 g of Tergitol 15-S-3 (diluted to 10 wt %) from Dow Chemical Corporation was added. The final ink contained 4.0% carbon 12% triethylene glycol, 8% glycerol, 0.4% water-soluble polymer P1, and 0.08% Tergitol 15-S-3. The solution was filtered through a 1.2 μm polytetrafluoroethylene filter. The resulting ink had the following physical properties: a surface tension of 32.0 dynes/cm at room temperature, a viscosity of 2.09 cps at room temperature, and a pH of 7.68. The 50% intensity mode particle size of the ink was about 113 nm as measured by MICROTRAC II Ultrafine particle analyzer (UPA) manufactured by Leeds & Northrup.

Comparative Ink 5C-5

Comparative ink 5C-5 was prepared similarly to ink 5C-4 except that 1.4 g of Tergitol 15-S-3 (diluted to 10 wt %) from Dow Chemical Corporation was added. The final ink contained 4.0% carbon 12% triethylene glycol, 8% glycerol, 0.4% water-soluble polymer P1, and 0.14% Tergitol 15-S-3. The solution was filtered through a 1.2 μM polytetrafluoroethylene filter. The resulting ink had the following physical properties: a surface tension of 31.5 dynes/cm at room temperature, a viscosity of 2.09 cps at room temperature, and a pH of 7.71. The 50% intensity mode particle size of the ink was about 114 nm as measured by MICROTRAC II Ultrafine particle analyzer (UPA) manufactured by Leeds & Northrup.

Comparative Ink 5C-6

Comparative ink 5C-6 was prepared similarly to ink 5C-1 except that 0.2 g of Surfynol 465 (diluted to 10 wt %) from Air Products and Chemicals Corporation was added in place of the Tergitol 15-S-12. The final ink contained 4.0% carbon 12% triethylene glycol, 8% glycerol, 0.4% water-soluble polymer P1, and 0.02% Surfynol 465. The solution was filtered through a 1.2 μm polytetrafluoroethylene filter. The resulting ink had the following physical properties: a surface tension of 45.1 dynes/cm at room temperature, a viscosity of 2.08 cps at room temperature, and a pH of 7.70. The 50% intensity mode particle size of the ink was about 109 nm as measured by MICROTRAC II Ultrafine particle analyzer (UPA) manufactured by Leeds & Northrup.

Comparative Ink 5C-7

Comparative ink 5C-7 was prepared similarly to ink 5C-6 except that 0.8 g of Surfynol 465 (diluted to 10 wt %) from Air Products and Chemicals Corporation was added. The final ink contained 4.0% carbon 12% triethylene glycol, 8% glycerol, 0.4% water-soluble polymer P1, and 0.08% Surfynol 465. The solution was filtered through a 1.2 μm polytetrafluoroethylene filter. The resulting ink had the following physical properties: a surface tension of 41.1 dynes/cm at room temperature, a viscosity of 2.08 cps at room temperature, and a pH of 7.70. The 50% intensity mode particle size of the ink was about 114 nm as measured by MICROTRAC II Ultrafine particle analyzer (UPA) manufactured by Leeds & Northrup.

Comparative Ink 5C-8

Comparative ink 5C-8 was prepared similarly to ink 5C-6 except that 1.4 g of Surfynol 465 (diluted to 10 wt %) from Air Products and Chemicals Corporation was added. The final ink contained 4.0% carbon 12% triethylene glycol, 8% glycerol, 0.4% water-soluble polymer P1, and 0.14% Surfynol 465. The solution was filtered through a 1.2 μm polytetrafluoroethylene filter. The resulting ink had the following physical properties: a surface tension of 39.2 dynes/cm at room temperature, a viscosity of 2.10 cps at room temperature, and a pH of 7.68. The 50% intensity mode particle size of the ink was about 111 nm as measured by MICROTRAC II Ultrafine particle analyzer (UPA) manufactured by Leeds & Northrup.

Comparative Ink 5C-9

Comparative ink 5C-9 was prepared similarly to ink 5C-1 except that the surfactant was removed. The final ink contained 4.0% carbon 12% triethylene glycol, 8% glycerol, and 0.4% water-soluble polymer P1. The solution was filtered through a 1.2 μm polytetrafluoroethylene filter. The resulting ink had the following physical properties: a surface tension of 45.1 dynes/cm at room temperature, a viscosity of 2.08 cps at room temperature, and a pH of 7.70. The 50% intensity mode particle size of the ink was about 109 nm as measured by MICROTRAC II Ultrafine particle analyzer (UPA) manufactured by Leeds & Northrup.

Comparative Ink 5C-10

Comparative ink 5C-10 was prepared similarly to ink 5C-1 except that 0.2 g of Strodex PK-90 (diluted to 10 wt %) from Dexter Chemical Corporation was added in place of the Tergitol 15-S-12. The final ink contained 4.0% carbon 12% triethylene glycol, 8% glycerol, 0.4% water-soluble polymer P1, and 0.02% Strodex PK-90. The solution was filtered through a 1.2 μm polytetrafluoroethylene filter. The resulting ink had the following physical properties: a surface tension of 40.9 dynes/cm at room temperature, a viscosity of 2.08 cps at room temperature, and a pH of 7.67. The 50% intensity mode particle size of the ink was about 115 nm as measured by MICROTRAC II Ultrafine particle analyzer (UPA) manufactured by Leeds & Northrup.

Inventive Ink 5I-2

Inventive ink 5I-2 was prepared similarly to ink 5C-10 except that 0.4 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.04% Strodex PK-90. The solution was filtered through a 1.2 μm polytetrafluoroethylene filter. The resulting ink had the following physical properties: a surface tension of 37.0 dynes/cm at room temperature, a viscosity of 2.08 cps at room temperature, and a pH of 7.68. The 50% intensity mode particle size of the ink was about 107 nm as measured by MICROTRAC II Ultrafine particle analyzer (UPA) manufactured by Leeds & Northrup.

Inventive Ink 5I-3

Inventive ink 5I-3 was prepared similarly to ink 5C-10 except that 0.6 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.06% Strodex PK-90. The solution was filtered through a 1.2 μm polytetrafluoroethylene filter. The resulting ink had the following physical properties: a surface tension of 35.0 dynes/cm at room temperature, a viscosity of 2.08 cps at room temperature, and a pH of 7.67. The 50% intensity mode particle size of the ink was about 112 nm as measured by MICROTRAC II Ultrafine particle analyzer (UPA) manufactured by Leeds & Northrup.

Inventive Ink 5I-4

Inventive ink 5I-4 was prepared similarly to ink 5C-10 except that 0.8 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.08% Strodex PK-90. The solution was filtered through a 1.2 μm polytetrafluoroethylene filter. The resulting ink had the following physical properties: a surface tension of 33.8 dynes/cm at room temperature, a viscosity of 2.08 cps at room temperature, and a pH of 7.67. The 50% intensity mode particle size of the ink was about 109 nm as measured by MICROTRAC II Ultrafine particle analyzer (UPA) manufactured by Leeds & Northrup.

Inventive Ink 5I-5

Inventive ink 5I-4 was prepared similarly to ink 5C-10 except that 1.0 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.10 Strodex PK-90. The solution was filtered through a 1.2 μm polytetrafluoroethylene filter. The resulting ink had the following physical properties: a surface tension of 32.7 dynes/cm at room temperature, a viscosity of 2.08 cps at room temperature, and a pH of 7.66. The 50% intensity mode particle size of the ink was about 108 nm as measured by MICROTRAC II Ultrafine particle analyzer (UPA) manufactured by Leeds & Northrup.

Comparative Ink 5C-11

Comparative ink 5C-11 was prepared similarly to ink 5C-10 except that 1.2 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.12% Strodex PK-90. The solution was filtered through a 1.2 μm polytetrafluoroethylene filter. The resulting ink had the following physical properties: a surface tension of 32.0 dynes/cm at room temperature, a viscosity of 2.09 cps at room temperature, and a pH of 7.66. The 50% intensity mode particle size of the ink was about 110 nm as measured by MICROTRAC II Ultrafine particle analyzer (UPA) manufactured by Leeds & Northrup.

Comparative Ink 5C-12

Comparative ink 5C-12 was prepared similarly to ink 5C-10 except that 1.4 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.14% Strodex PK-90. The solution was filtered through a 1.2 μm polytetrafluoroethylene filter. The resulting ink had the following physical properties: a surface tension of 31.4 dynes/cm at room temperature, a viscosity of 2.09 cps at room temperature, and a pH of 7.67. The 50% intensity mode particle size of the ink was about 112 nm as measured by MICROTRAC II Ultrafine particle analyzer (UPA) manufactured by Leeds & Northrup.

Inventive Ink 5I-6

Inventive ink 5I-6 was prepared similarly to ink 5C-1 except that 0.2 g of Zonyl FSO (diluted to 10 wt %) from E.I. du Pont de Nemours and Company was added in place of the Tergitol 15-S-12. The final ink contained 4.0% carbon 12% triethylene glycol, 8% glycerol, 0.4% water-soluble polymer P1, and 0.02% Zonyl FSO. The solution was filtered through a 1.2 μm polytetrafluoroethylene filter. The resulting ink had the following physical properties: a surface tension of 21.6 dynes/cm at room temperature, a viscosity of 2.08 cps at room temperature, and a pH of 7.68. The 50% intensity mode particle size of the ink was about 113 nm as measured by MICROTRAC II Ultrafine particle analyzer (UPA) manufactured by Leeds & Northrup.

Inventive Ink 5I-7

Inventive ink 5I-7 was prepared similarly to ink 5I-6 except that 0.8 g of Zonyl FSO (diluted to 10 wt %) from E.I. du Pont de Nemours and Company was added. The final ink contained 4.0% carbon 12% triethylene glycol, 8% glycerol, 0.4% water-soluble polymer P1, and 0.08% Zonyl FSO. The solution was filtered through a 1.2 μm polytetrafluoroethylene filter. The resulting ink had the following physical properties: a surface tension of 20.9 dynes/cm at room temperature, a viscosity of 2.09 cps at room temperature, and a pH of 7.67. The 50% intensity mode particle size of the ink was about 115 nm as measured by MICROTRAC II Ultrafine particle analyzer (UPA) manufactured by Leeds & Northrup.

Comparative Ink 5C-13

Inventive ink 5C-13 was prepared similarly to ink 5I-6 except that 1.4 g of Zonyl FSO (diluted to 10 wt %) from E.I. du Pont de Nemours and Company was added. The final ink contained 4.0% carbon 12% triethylene glycol, 8% glycerol, 0.4% water-soluble polymer P1, and 0.14% Zonyl FSO. The solution was filtered through a 1.2 μm polytetrafluoroethylene filter. The resulting ink had the following physical properties: a surface tension of 20.3 dynes/cm at room temperature, a viscosity of 2.09 cps at room temperature, and a pH of 7.66. The 50% intensity mode particle size of the ink was about 111 nm as measured by MICROTRAC II Ultrafine particle analyzer (UPA) manufactured by Leeds & Northrup.

System Test Printing Evaluation

All fresh inks of Example 5 were filled into printer compatible empty text black cartridges and printed along with ink from a color ink cartridge containing photo black, yellow, magenta and cyan pigmented inks with a Kodak 5250 thermal ink jet printer. After priming, a nozzle check target was printed to establish that all nozzles of all colors were firing properly. Then two full 8.5" by 11" pages were uniformly printed using just the text black channel at an ink laydown that represented 70% of the maximum laydown. After that, a test target was printed in a 2 pass, bidirectional mode on Hammermill Great White Copy Paper item 86700. The test target contained a bar chart of all five pigmented ink channels (text black, photo black, yellow, magenta, and cyan) as well as the secondary primaries (red, green, and blue). For the text black channel, a solid area of 0.5 inch by 2.5 inch at 100% dot coverage was printed. The Status A reflection density of the printed black patch was measured on the visual channel using a SpectroScan densitometer manufactured by GreytagMacbeth.

Table 5 lists the results for the Example 5 experiments. Listed in the table is the ink designation, the surfactant in each ink, the concentration of surfactant, the measured surface tension, the printed visual density, and the bubbler tank performance as determined in Example 1 based on the measured surface tension.

TABLE 5

Example 5 results

| ink | surfactant | % surfactant | surface tension | density | tank performance |
|---|---|---|---|---|---|
| 5C-1 | 15-S-12 | 0.02 | 44.6 | 1.24 | poor |
| 5C-2 | 15-S-12 | 0.08 | 39.1 | 1.28 | poor |
| 5C-3 | 15-S-12 | 0.14 | 37.4 | 1.15 | good |
| 5C-4 | 15-S-3 | 0.02 | 38.2 | 1.28 | poor |
| 5I-1 | 15-S-3 | 0.08 | 32.0 | 1.25 | good |
| 5C-5 | 15-S-3 | 0.14 | 31.5 | 1.18 | good |
| 5C-6 | Surfynol | 0.02 | 45.1 | 1.29 | poor |
| 5C-7 | Surfynol | 0.08 | 41.1 | 1.24 | poor |
| 5C-8 | Surfynol | 0.14 | 39.2 | 1.17 | poor |

TABLE 5-continued

Example 5 results

| ink | surfactant | % surfactant | surface tension | density | tank performance |
|---|---|---|---|---|---|
| 5C-9 | none | 0.00 | 50.0 | 1.32 | poor |
| 5C-10 | PK-90 | 0.02 | 40.9 | 1.29 | poor |
| 5I-2 | PK-90 | 0.04 | 37.0 | 1.28 | good |
| 5I-3 | PK-90 | 0.06 | 35.0 | 1.28 | good |
| 5I-4 | PK-90 | 0.08 | 33.8 | 1.26 | good |
| 5I-5 | PK-90 | 0.10 | 32.7 | 1.22 | good |
| 5C-11 | PK-90 | 0.12 | 32.0 | 1.18 | poor |
| 5C-12 | PK-90 | 0.14 | 31.4 | 1.17 | poor |
| 5I-6 | FSO | 0.02 | 21.6 | 1.31 | good |
| 5I-7 | FSO | 0.08 | 20.9 | 1.24 | good |
| 5C-13 | FSO | 0.14 | 20.3 | 1.16 | good |

These results were consistent with the previous example results. They show that both higher printed density and good bubbler tank performance are achieved when the surface tension is less than 37.5 dynes/cm and the surfactant concentration is less than or equal to 0.10%.

Example 6

Ink Preparation

Comparative Ink 6C-1

To prepare Ink 6C-1, 26.5 g of self-dispersed carbon black Cabojet 300 from Cabot Corporation (15.1 wt % active), 12 g of triethylene glycol, 8 g of glycerol, 2.0 g of water soluble polymer P1 solution (20% active), 0.2 g of Strodex PK-90 (diluted to 10 wt %) from Dexter Chemical Corporation, and 2.8 g potassium carbonate solution (5% active) were added together with distilled water so that the final weight of the ink was 100.0 g. The volatile surface functional groups for this dispersion were measured to be 5.0 wt. %. The final ink contained 4.0% carbon 12% triethylene glycol, 8% glycerol, 0.4% water-soluble polymer P1, and 0.02% Strodex PK-90. The solution was filtered through a 1.2 μm polytetrafluoroethylene filter. The resulting ink had the following physical properties: a surface tension of 47.8 dynes/cm at room temperature, a viscosity of 2.13 cps at room temperature, and a pH of 8.46. The 50% intensity mode particle size of the ink was about 137 nm as measured by MICROTRAC II Ultrafine particle analyzer (UPA) manufactured by Leeds & Northrup.

Comparative Ink 6C-2

Comparative ink 6C-2 was prepared similarly to ink 6C-1 except that 0.8 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.08% Strodex PK-90. The solution was filtered through a 1.2 μm polytetrafluoroethylene filter. The resulting ink had the following physical properties: a surface tension of 39.5 dynes/cm at room temperature, a viscosity of 2.13 cps at room temperature, and a pH of 8.47. The 50% intensity mode particle size of the ink was about 139 nm as measured by MICROTRAC II Ultrafine particle analyzer (UPA) manufactured by Leeds & Northrup.

Comparative Ink 6C-3

Comparative ink 6C-3 was prepared similarly to ink 6C-1 except that 1.4 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.14% Strodex PK-90. The solution was filtered through a 1.2 μm polytetrafluoroethylene filter. The resulting ink had the following physical properties: a surface tension of 35.2 dynes/cm at room temperature, a viscosity of 2.14 cps at room temperature, and a pH of 8.43. The 50% intensity mode particle size of the ink was about 135 nm as measured by MICROTRAC II Ultrafine particle analyzer (UPA) manufactured by Leeds & Northrup.

Comparative Ink 6C-4

To prepare Ink 6C-4, 32.2 g of carbon Black Pearls 880 from Cabot Corporation milled with potassium oleoylmethyltaurine (12.4 wt % active), 12 g of triethylene glycol, 8 g of glycerol, 2.0 g of water soluble polymer P1 solution (20% active), 0.2 g of Strodex PK-90 (diluted to 10 wt %) from Dexter Chemical Corporation, and 2.8 g potassium carbonate solution (5% active) were added together with distilled water so that the final weight of the ink was 100.0 g. This carbon has not been surface-functionalized to be a self-dispersed carbon, so the volatile surface functional groups for this dispersion would be very low and are not reported. The final ink contained 4.0% carbon 12% triethylene glycol, 8% glycerol, 0.4% water-soluble polymer P1, and 0.02% Strodex PK-90. The solution was filtered through a 1.2 μm polytetrafluoroethylene filter. The resulting ink had the following physical properties: a surface tension of 36.6 dynes/cm at room temperature, a viscosity of 2.08 cps at room temperature, and a pH of 9.66. The 50% intensity mode particle size of the ink was about 84 nm as measured by MICROTRAC II Ultrafine particle analyzer (UPA) manufactured by Leeds & Northrup.

Comparative Ink 6C-5

Comparative ink 6C-5 was prepared similarly to ink 6C-4 except that 0.8 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.08% Strodex PK-90. The solution was filtered through a 1.2 μm polytetrafluoroethylene filter. The resulting ink had the following physical properties: a surface tension of 36.2 dynes/cm at room temperature, a viscosity of 2.08 cps at room temperature, and a pH of 9.66. The 50% intensity mode particle size of the ink was about 83 nm as measured by MICROTRAC II Ultrafine particle analyzer (UPA) manufactured by Leeds & Northrup.

Comparative Ink 6C-6

Comparative ink 6C-6 was prepared similarly to ink 6C-4 except that 1.4 g of Strodex PK-90 (diluted to 10 wt %) from Dexter Chemical Corporation was added. The final ink contained 4.0% carbon 12% triethylene glycol, 8% glycerol, 0.4% water-soluble polymer P1, and 0.14% Strodex PK-90. The solution was filtered through a 1.2 μm polytetrafluoroethylene filter. The resulting ink had the following physical properties: a surface tension of 35.8 dynes/cm at room temperature, a viscosity of 2.09 cps at room temperature, and a pH of 9.60. The 50% intensity mode particle size of the ink was about 81 nm as measured by MICROTRAC II Ultrafine particle analyzer (UPA) manufactured by Leeds & Northrup.

System Test Printing Evaluation

All fresh inks of Example 6 were filled into printer compatible empty text black cartridges and printed along with ink from a color ink cartridge containing photo black, yellow, magenta and cyan pigmented inks with a Kodak 5250 thermal ink jet printer. After priming, a nozzle check target was printed to establish that all nozzles of all colors were firing properly. Then two full 8.5" by 11" pages were uniformly printed using just the text black channel at an ink laydown that represented 70% of the maximum laydown. After that, a test target was printed in a 2 pass, bidirectional mode on Hammermill Great White Copy Paper item 86700. The test target contained a bar chart of all five pigmented ink channels (text black, photo black, yellow, magenta, and cyan) as well as the secondary primaries (red, green, and blue). For the text black channel, a solid area of 0.5 inch by 2.5 inch at 100% dot coverage was printed. The Status A reflection density of the printed black patch was measured on the visual channel using a SpectroScan densitometer manufactured by GreytagMacbeth.

Table 6 lists the results for the Example 6 inks plus the results for three inks repeated from Example 5. Listed in the table is the ink designation, the surfactant in each ink, the concentration of surfactant, the measured percent volatile surface functional groups for the pigment, the measured surface tension, and the printed visual density.

TABLE 6

Example 6 results

| ink | surfactant | % surfactant | pigment % volatiles | surface tension | Printed Visual Density |
|---|---|---|---|---|---|
| 5C-10 | PK-90 | 0.02 | 14.6 | 40.9 | 1.29 |
| 5I-4 | PK-90 | 0.08 | 14.6 | 33.8 | 1.26 |
| 5C-12 | PK-90 | 0.14 | 14.6 | 31.4 | 1.17 |
| 6C-1 | PK-90 | 0.02 | 5.0 | 47.8 | 1.16 |
| 6C-2 | PK-90 | 0.08 | 5.0 | 39.5 | 1.15 |
| 6C-3 | PK-90 | 0.14 | 5.0 | 35.2 | 1.13 |
| 6C-4 | PK-90 | 0.02 | N/A | 36.6 | 0.79 |
| 6C-5 | PK-90 | 0.08 | N/A | 36.2 | 0.79 |
| 6C-6 | PK-90 | 0.14 | N/A | 35.8 | 0.77 |

These results show that magnitude of the improvement in density for surfactant concentrations less than 0.10% occurred only when the pigment was self-dispersed and the self-dispersed pigment had greater than 11% volatile surface functional groups.

PARTS LIST

10 inkjet printer
12 image data source
18 ink tanks
20 recording medium supply
22 printed media collection
30 printhead
40 protective cover
100 carriage
200 tank body
201 tank top
215 optical sensor
300 vent
302 media direction
303 print region
304 media direction
312 feed roller
313 forward direction
320 pickup roller(s)
322 turn roller(s)
323 idler roller(s)
324 discharge roller(s)
325 star wheel(s)
350 media transport path
360 media supply tray
371 media sheet
375 further optical sensor
380 media output tray
390 printed media sheet
400 ink fill hole
500 drain port
501 capillary wick
502 drain port valve

600 access port
601 access port
700 ink chamber
701 capillary media
702 capillary media
703 capillary media
800 barrier wall
900 free ink chamber

The invention claimed is:

1. An inkjet printing system comprising an inkjet printer having a printhead and an inkjet ink in an ink tank supplying the inkjet ink to the printhead, wherein the ink tank comprises a free ink compartment and a capillary media compartment vented to the atmosphere and in fluid communication with ink in the free ink compartment, and wherein the inkjet ink comprises water, a self-dispersing carbon black pigment having greater than 11 weight % volatile surface functional groups, and a surfactant at a concentration of 0.10 weight percent or less, and having a static surface tension of 37.5 dynes/cm or less at 25° C.

2. The inkjet printing system of claim 1 wherein the self-dispersing carbon black pigment comprises greater than 14 weight % volatile surface functional groups.

3. The inkjet printing system of claim 1 wherein the self-dispersing carbon black pigment comprises greater than 18 weight % volatile surface functional group.

4. The inkjet printing system of claim 1 wherein the self-dispersing carbon black pigment is anionically charged.

5. The inkjet printing system of claim 1 wherein 50 weight % of the pigment particles have a particle size of less than 200 nm.

6. The inkjet printing system of claim 1 wherein the total amount of pigment is 0.1 weight % to 6.0 weight % of the ink.

7. The inkjet printing system of claim 1, wherein the inkjet ink further comprises a water-soluble polymer containing carboxylate groups.

8. The inkjet printing system of claim 7 wherein the water-soluble polymer has a weight average molecular weight of from 4,000 to 40,000 Daltons.

9. The inkjet printing system of claim 7 wherein the water-soluble polymer has an acid number of from 100 to 270.

10. The inkjet printing system of claim 1, wherein the inkjet ink has a static surface tension of 37 dynes/cm or less at 25° C.

11. The inkjet printing system of claim 1, wherein the inkjet ink comprises a surfactant at a concentration of 0.05 weight percent or less.

12. The inkjet printing system of claim 11, wherein the inkjet ink has a static surface tension of 37 dynes/cm or less at 25° C.

13. The inkjet printing system of claim 1, wherein the surfactant in the inkjet ink is a linear or secondary alcohol ethoxylate, a phosphated ester of an alkyl or aryl alcohol, or a fluoro surfactant.

14. The inkjet printing system of claim 1, wherein the surfactant in the inkjet ink is a fluoro surfactant.

15. The inkjet printing system of claim 1, wherein the surfactant in the inkjet ink is a phosphated ester of an alkyl or aryl alcohol.

16. A method for printing an inkjet image with an inkjet printhead comprising:

I) providing an aqueous inkjet ink in an ink tank, wherein the ink tank comprises a free ink compartment and a capillary media compartment vented to the atmosphere and in fluid communication with ink in the free ink compartment, and wherein the inkjet ink comprises water, a self-dispersing carbon black pigment having greater than 11 weight % volatile surface functional groups, and a surfactant at a concentration of 0.10 weight percent or less, and having a static surface tension of 37.5 dynes/cm or less at 25° C.;

II) supplying the inkjet ink from the ink tank to an inkjet printhead; and

III) jetting the inkjet ink from the printhead in the form of ink drops onto a recording element to form a printed image.

17. The method of claim 16, wherein the inkjet ink has a static surface tension of 37 dynes/cm or less at 25° C.

18. The method of claim 16, wherein the inkjet ink comprises a surfactant at a concentration of 0.05 weight percent or less.

19. The method of claim 16, wherein the surfactant in the inkjet ink is a phosphated ester of an alkyl or aryl alcohol, or a fluoro surfactant.

20. The method of claim 16, wherein the surfactant in the inkjet ink is a fluoro surfactant.

* * * * *